US006752668B2

(12) United States Patent
Koch, Jr.

(10) Patent No.: US 6,752,668 B2
(45) Date of Patent: Jun. 22, 2004

(54) ELECTRICAL CONNECTOR

(75) Inventor: Joseph J. Koch, Jr., Harrison Township, MI (US)

(73) Assignee: KonneKtech, Ltd., Wallingford, CT (US)

( * ) Notice: Subject to any disclaimer, the term of this patent is extended or adjusted under 35 U.S.C. 154(b) by 89 days.

(21) Appl. No.: 10/218,760

(22) Filed: Aug. 14, 2002

(65) Prior Publication Data

US 2004/0033732 A1 Feb. 19, 2004

(51) Int. Cl.[7] ..... H01R 13/187
(52) U.S. Cl. ..... 439/843; 439/387
(58) Field of Search ..... 439/843, 856, 439/842, 851–857, 862, 387, 839, 272, 585, 610

(56) References Cited

U.S. PATENT DOCUMENTS

| | | | | |
|---|---|---|---|---|
| 4,168,878 A | | 9/1979 | Risser et al. | 339/217 |
| 4,461,530 A | | 7/1984 | Brush, Sr. et al. | 339/258 |
| 4,550,972 A | | 11/1985 | Romak | 339/256 |
| 4,657,335 A | * | 4/1987 | Koch et al. | 439/851 |
| 4,662,706 A | | 5/1987 | Foley | 339/256 |
| 4,720,157 A | | 1/1988 | Nestor et al. | 439/851 |
| 4,734,063 A | * | 3/1988 | Koch et al. | 439/844 |
| 4,753,616 A | * | 6/1988 | Molitor | 439/787 |
| 4,775,325 A | | 10/1988 | Wilson | 439/278 |
| 4,907,983 A | | 3/1990 | Wilson | 439/278 |
| 5,083,927 A | | 1/1992 | Herald et al. | 439/80 |
| 5,088,942 A | * | 2/1992 | Welsh et al. | 439/843 |
| 5,147,229 A | | 9/1992 | Nestor | 439/843 |
| 5,203,813 A | | 4/1993 | Fitzsimmons et al. | 29/876 |
| 5,403,199 A | | 4/1995 | Mobley et al. | 439/357 |
| 5,431,576 A | | 7/1995 | Matthews | 439/247 |
| 5,591,039 A | | 1/1997 | Matthews | 439/181 |
| 5,599,212 A | | 2/1997 | Sawada | 439/843 |

(List continued on next page.)

FOREIGN PATENT DOCUMENTS

| | | |
|---|---|---|
| DE | 43 12 641 | 10/1994 |
| EP | 0 147 332 | 7/1995 |
| FR | 2 691 852 | 3/1993 |
| GB | 2 048 581 | 12/1980 |

*Primary Examiner*—P. Austin Bradley
*Assistant Examiner*—Phoungchi Nguyen
(74) *Attorney, Agent, or Firm*—Blank Rome LLP

(57) ABSTRACT

An electrical connector employing a radially resistant barrel socket having a bore extending from one end which slidably receives an electrically conductive pin. A spacer member is disposed to space a stop member from the one end of the barrel socket. An inner diameter of a bore in the spacer member is greater than the inner diameter of the adjacent bores in the stop member and the barrel socket to define a recess which receives a projection carried on the pin which the pin is inserted into the barrel socket. An end cap is fixed over the stop member and the spacer member and to the barrel socket to resist axially outward flexure of an inner edge portion of the stop member upon the exertion of pull-out forces on the pin and the barrel socket tending to disengage the pin from the barrel socket.

17 Claims, 16 Drawing Sheets

U.S. PATENT DOCUMENTS 5,649,838 A * 7/1997 Sung ..... 439/578
5,667,413 A 9/1997 Trafton ..... 439/843
5,720,634 A 2/1998 Sten ..... 439/843
5,730,628 A * 3/1998 Hawkins ..... 439/843
5,735,716 A * 4/1998 Bilezikjian ..... 439/843
5,762,510 A 6/1998 Taniguchi et al. ..... 439/271
5,775,960 A 7/1998 Saito et al. ..... 439/843
5,807,120 A 9/1998 Matthews ..... 439/80
5,822,824 A * 10/1998 Dion ..... 15/210.1
5,921,803 A * 7/1999 Mori ..... 439/387
6,042,432 A * 3/2000 Hashizawa et al. ..... 439/843
6,062,919 A 5/2000 Trafton ..... 439/843
6,080,023 A 6/2000 Meulemeester et al. .... 439/752
6,086,405 A 7/2000 Liebich ..... 439/397
6,126,475 A * 10/2000 Matsuura et al. ..... 439/381
6,152,752 A 11/2000 Fukuda ..... 439/275
6,174,200 B1 1/2001 Bigotto et al. ..... 439/587
6,200,164 B1 3/2001 Martin et al. ..... 439/595
6,206,720 B1 3/2001 Larkin et al. ..... 439/395
6,217,395 B1 4/2001 Flieger et al. ..... 439/857
6,250,966 B1 6/2001 Hashimoto et al. ..... 439/631
6,305,993 B1 10/2001 Heimueller ..... 439/852
6,315,591 B2 11/2001 Oda et al. ..... 439/252
6,398,574 B1 * 6/2002 Biermann et al. ..... 439/350

* cited by examiner

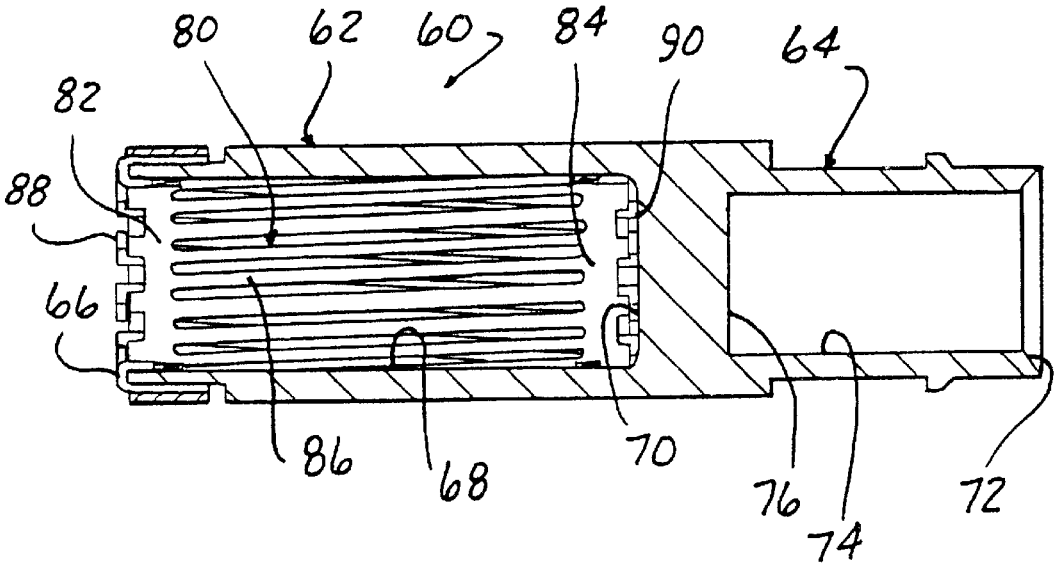
FIG. 9
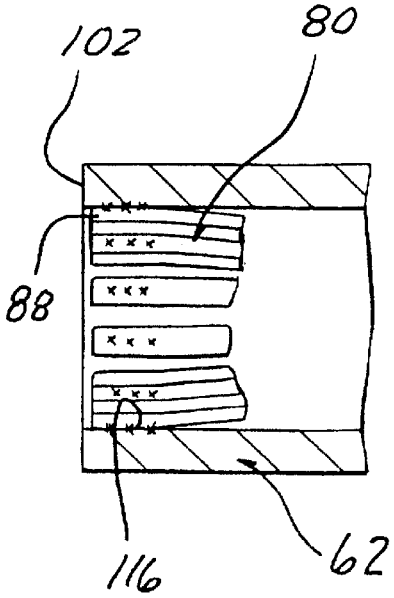
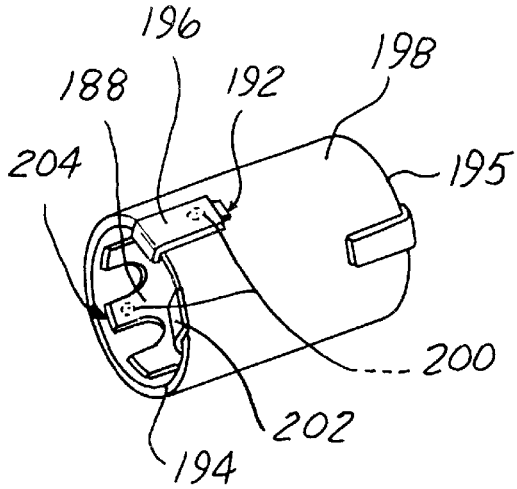
FIG. 22
FIG. 12

ELECTRICAL CONNECTOR

BACKGROUND

The present invention relates, in general, to electrical connectors and, more specifically, to radially resilient electrical sockets, also referred to as barrel terminals, in which a cylindrical electrical prong or pin is axially inserted into a socket whose interior surface is defined by a plurality of contact strips or wires which are bent into a hyperbolic, radially inward extending shape by angularly offset strip ends.

Radially resilient electrical sockets or barrel terminals are a well known type of electrical connector as shown in U.S. Pat. Nos. 4,657,335 and 4,734,063.

In such electrical sockets or barrel terminals, a generally rectangular stamping is formed with two transversely extending webs spaced inwardly from and parallel to opposite end edges of the sheet. Between the inner side edges of the transverse web, a plurality of uniformly spaced, parallel slots are formed to define a plurality of uniformly spaced, parallel, longitudinally extending strips which are joined at opposite ends to the inward side edges of both transverse webs. Other longitudinally extending slots are coaxially formed in the sheet and extend inwardly from the end edges of the blank to the outer side edges of the transverse webs to form a plurality of uniformly spaced, longitudinally extending tabs projecting outwardly from each transverse web.

The blank or sheet is then formed into a cylinder with the longitudinal strips extending parallel to the axis of the now cylindrical sheet. A closely fitting cylindrical sleeve is slipped coaxially around the outer periphery of the cylindrical blank, and extends axially substantially between the outer edges of the transverse webs. The mounting tabs at each end of the blank are then bent outwardly across end edges of the sleeve into radially extending relationship to the sleeve.

A relatively tight-fitting annular collar or outer barrel is then axially advanced against the radially projecting tabs at one end of the sleeve and slipped over the one end of the sleeve driving the tabs at that end of the sleeve downwardly into face-to-face engagement with the outer surface of the one end of the sleeve. The fit of the annular collar to the sleeve is chosen so that the end of the cylindrical blank at which the collar is located is fixedly clamped to the sleeve against both axial or rotary movement relative to the sleeve.

A tool typically having an annular array of uniformly spaced, axially projecting teeth is then engaged with the radially projecting tabs at the opposite end of the sleeve. The teeth on the tool are located to project axially between the radially projecting tabs closely adjacent to the outer surface of the cylindrical sleeve. The tool is then rotated about the longitudinal axis of the cylindrical sleeve while the sleeve is held stationary to rotatably displace the engaged tabs approximately 15° to 45° from their original rotative orientation relative to the sleeve and the bent over tabs at the opposite end of the sleeve. The tool is then withdrawn and a second annular collar or outer barrel is force fitted over the tabs and the sleeve to fixedly locate the opposite end of the blank in a rotatably offset position established by the tool.

When completed, such an electrical socket has longitudinal strips extending generally along a straight line between the angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of a cylindrical connector pin which is to be inserted into the barrel socket so that the insertion of the pin requires the individual longitudinal strips to stretch slightly longitudinally to firmly frictionally grip the pin when it is seated within the barrel socket.

To put it another way, because of the angular offset orientation of the opposed ends of each of the strips, each strip is spaced from the inner wall of the sleeve in a radial direction progressively reaching a maximum radial spacing with respect to the outer sleeve midway between the ends of the sleeve.

Such a radially resilient electrical barrel socket provides an effective electrical connector which provides secure engagement with an insertable pin; while still enabling easy manual withdrawal or insertion of the pin relative to the socket. Such connectors also provide a large electrical contact area between the pin and the socket which enables such connectors to be employed in high current applications.

It is also known to construct such an electrical connector in a manner in which one of the collars is formed as an integral part or extension of a support member forming a part of the overall connector. The afore-described assembly process remains the same except that the separate collars at both ends of the socket are replaced by one collar at one end and a hollow, cylindrical extension of a connector which can be inserted into or otherwise electrically connected to an electrical device, such as a vehicle alternator, etc. The hollow cylindrical end of the support receives and holds the tabs at the first end of the sleeve tight against rotation while the opposing tabs are angularly rotated. A collar or end cap is then clamped over the rotated tabs to maintain such tabs in the rotated position.

Such radially resistant sockets are adapted for receiving generally cylindrical pins or terminals which are slid into the open end of the bore extending through the contact into forced engagement with the hyperbolically shaped contact grid contact strips. The pin displaces the hyperbolically shaped strips which generates a holding force to retain the pin in the socket or barrel terminal under a predetermined retention or pull-out force resistance.

Also known in the connector art are detent mechanisms employed on the pin and socket to increase the pull-out force resistance holding the pin in the socket. Such a detent mechanism typically employs a radially inward extending projection on one or more of the grid strips which engages an annular recess formed in the pin. This detent not only forms a detectable insertion stop for the pin into the electrical socket; but, also, increases the pull-out force resistance due to the mechanical and friction engagement between the grid contact projection(s) and the annular recess in the pin.

However, such detent mechanisms provide only a predetermined amount of pull-out force resistance. Certain electrical connector applications may desirably require increased pull-out force resistance magnitudes.

Thus, it would be desirable to provide an electrical connector employing a radially resistant electrical socket which has increased pull-out force resistance with minimal modification to the socket design. It would also be desirable to provide such an electrical connector in which the pull-out force resistance can be easily varied to suit various application requirements.

SUMMARY

In one aspect of the present invention, an electrical connector is disclosed as including a radially resilient barrel socket having a bore with a first inner diameter extending from a first end. A stop member has a bore with a second inner diameter at least as large as the first diameter of the bore in the barrel socket. Means are provided for spacing the stop member from the one end of the barrel socket and defining a recess between the second inner diameter of the bore in the stop member and the one end of the barrel socket. The recess has a third inner diameter greater than the second inner diameter and the one end of the bore in the barrel socket. Means are provided for fixing the stop member and the spacing means with respect to the one end of the barrel socket. An electrically conductive member having an end pin is insertable through the fixing means, the spacing means and the stop member into the bore in the barrel socket. At least one projection is carried on the pin. The at least one projection is insertable through the inner diameter of a bore formed in the fixing means into the recess defined by the spacing means. An inner edge of the bore in the fixing means and an inner edge of the bore in the spacing means resisting movement of the at least one projection on the pin axially outward from the one end of the barrel socket up to a predetermined pull-out force.

In another aspect, the spacing means is a spacer member having a bore with the third inner diameter. The third inner diameter is larger than the second inner diameter of the stop member and the first inner diameter of the bore in the barrel socket. The recess is formed radially inward of the third inner diameter of the spacer member.

In another aspect, the fixing means includes an end cap having a sidewall and an end wall. A bore is formed in the end wall of an inner diameter sized to allow free passage of the at least one projection therethrough. An inner edge of the end wall surrounding the inner diameter of the bore is disposed adjacent to an inner edge of the spacing means surrounding the bore in the spacing means to resist axially outward flexure of the inner edge of the spacing means forces are exerted on the pin and the connector tending to move the pin is moved in an axially outward direction relative to the one end of the barrel socket. The end cap is preferably fixedly mounted on the barrel socket.

In one aspect, the at least one projection includes a single continuous, annular projection on the pin.

In another aspect, the spacing means has an inner edge surrounding the bore in the spacing means which is capable of axial flexure on insertion of the projection on the pin therethrough to allow passage of the projection into the recess. The fixing means and the spacing means resist flexure of the inner edge of the spacing means in an axial direction away from the one end of the barrel socket in a direction tending to separate the pin from the barrel socket.

The electrical connector according to the present invention uniquely provides different insertion or push-in force levels and pull-out force levels with the same connector structure. Without modification to an existing resilient barrel socket contact, the addition of a few additional components provides for a comparatively low push-in insertion force to trap a projection on an end pin portion of an electrically conductive end form in a recess formed at one end of the electrical connector. Pull-out movement of the projection and the end form from the barrel socket contact is resisted up to a comparatively high pull-out force level to resist separation of the conductive member from the connector body.

The inventive electrical connector employs a radially resilient electrical socket of many different configurations which is provided with a pull-out force resistance means to enable the pull-out force resistance of a pin insertable into the electrical socket to be increased to higher magnitudes as well as being able to be variably selected to suit different application requirements. This increased pull-out force resistance is achieved with few, if any, modifications to the electrical socket structure.

BRIEF DESCRIPTION OF THE DRAWING

The various features, advantages and other uses of the present invention will become more apparent by referring to the following detailed description and drawing in which:

FIG. 9 is a longitudinal cross-sectional view of another aspect of a connector and a barrel terminal useable in the present invention;

FIG. 12 is a partial, longitudinal cross-sectional view showing another aspect of an external grid anchor;

FIGS. 22–24 depict sequential steps in the construction method for an alternate barrel socket.

DETAILED DESCRIPTION

An electrical connector employs a radially resilient electrical contact or socket having hyperbolically shaped contact strips or wires, a holder which receives at least a portion of the socket, hereafter referred to as a "barrel socket or terminal", and a conductive end form which is slidably inserted into the barrel socket to complete an electrical circuit between circuit elements connected to or carried by the end form and circuit elements connected to or carried by the holder in which the barrel socket is mounted.

The structure of a barrel socket used in an electrical connector according to one aspect of the present invention is best explained by a description of the manner in which it is manufactured.

Figure 1:
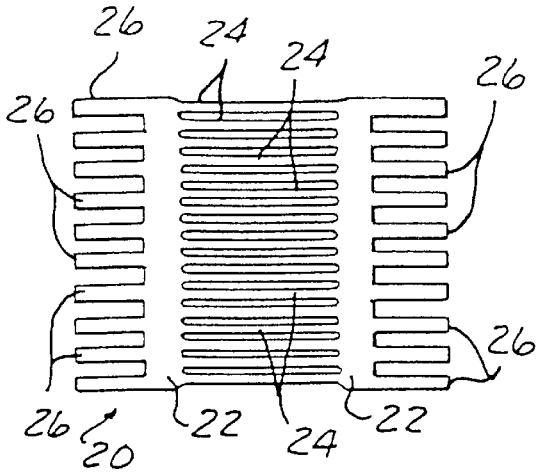
FIG. 1 PRIOR ART
FIG. 1 is a plan view of a flat sheet metal blank employed in constructing a barrel terminal for use in the present invention.

The first step in the manufacture of the barrel socket is the stamping of a blank in the form shown in FIG. 1 from a flat piece of sheet metal which preferably is a beryllium copper alloy which has both mechanical and electrical properties well adapted for an electrical connector application.

Referring to FIG. 1, the blank designated generally 20 is stamped in a generally rectangular configuration and formed with a pair of spaced, parallel, transversely extending connecting web portions 22 which are integrally connected to each other by a plurality of uniformly spaced, parallel, longitudinally extending strips 24 which extend between the respective inner edges of the webs 22. A plurality of spaced, parallel tabs 26 project longitudinally outwardly from the outer edges of the respective transverse webs 22.

Figure 2:
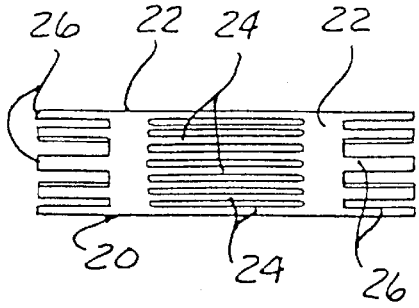
FIG. 2 PRIOR ART
FIG. 2 is a side elevational view of the blank of FIG. 1 formed into a cylinder.

The second step in the manufacturing process is shown in FIG. 2 and finds the blank 20 formed into a horizontal, cylindrical, tubular configuration, the axis of the cylindrical tube extending parallel to the longitudinal strips 24 and tabs 26.

Figure 3:
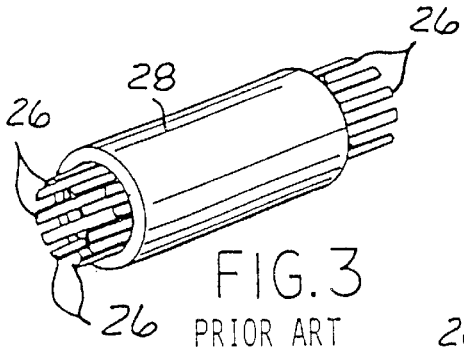
FIG. 3 PRIOR ART
FIG. 3 is a perspective view showing a close fitting cylindrical sleeve disposed about the blank of FIG. 2.

After the blank 20 is formed into the cylindrical tubular configuration of FIG. 2, a close-fitting cylindrical sleeve 28 is slipped over the cylindrical tube as shown in FIG. 3, the axial length of sleeve 28 being sufficient to extend over both of transverse webs 22 leaving the tabs 26 projecting outwardly from the opposite ends of sleeve 28.

Figure 4:
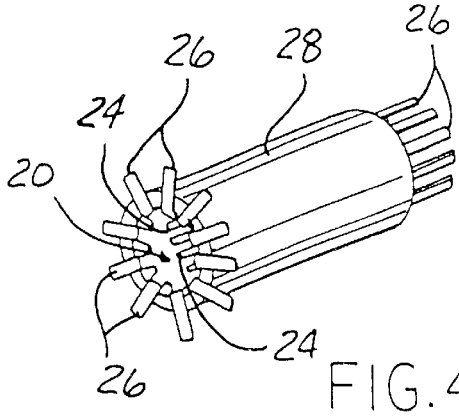
FIG. 4 PRIOR ART
FIG. 4 is a perspective view of a subsequent step in the construction of the barrel terminal.

In the next step shown in FIG. 4, the projecting tabs 26 are flared or bent outwardly across one end edge of sleeve 28 to project radially outwardly of the axis of the sleeve.

Figure 5:
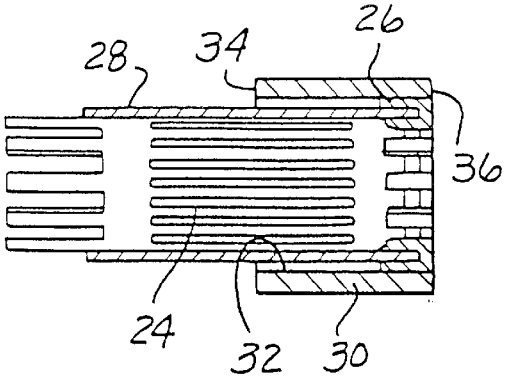
FIG. 5 PRIOR ART
FIG. 5 is an enlarged side elevational, cross-sectional view showing a subsequent step in the construction method.

In the next step of the process shown in FIG. 5, a temporary first housing or fixture 30 has a central bore 32 extending at least from a first end 34 to an opposite end 36. The bore 32 has a diameter larger than the diameter of the cylindrical sleeve 28 by a distance equal to the thickness of the tabs 26. The first housing 30 is axially driven over one end of the sleeve 28 or the sleeve 28 is axially driven into one of the first and second ends 34 and 36 of the first housing 30. The forcible interconnection of the sleeve 28 and the first housing 30 bends the radially flared tabs 26 at the one end of the sleeve 28 back on themselves into overlapping, face-to-face relationship with the outer surface of the sleeve 28. The inner diameter of the bore 32 is chosen such that when the first housing 30 and the first end of the blank 20 and the sleeve 28 are in the position shown in FIG. 5, the first housing 30 exerts sufficient force on the tabs 26 to clamp the tabs 26 against the outer surface of the sleeve 28 to prevent any axial or rotary movement of the tabs 26 relative to the sleeve 28.

Figure 6:
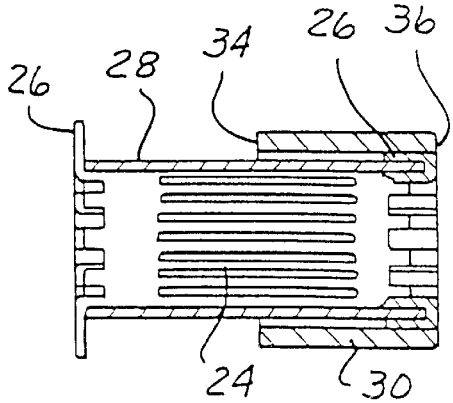
FIG. 6 PRIOR ART
FIG. 6 is an enlarged side elevational, cross-sectional view showing yet another step in the construction method.

Next, as shown in FIG. 6, the tabs 26 at the opposite end of the sleeve 28 are flared or bent radially outwardly across the opposite end edge of the sleeve 28 to project radially outward from the axis of the sleeve 28.

Figure 7:
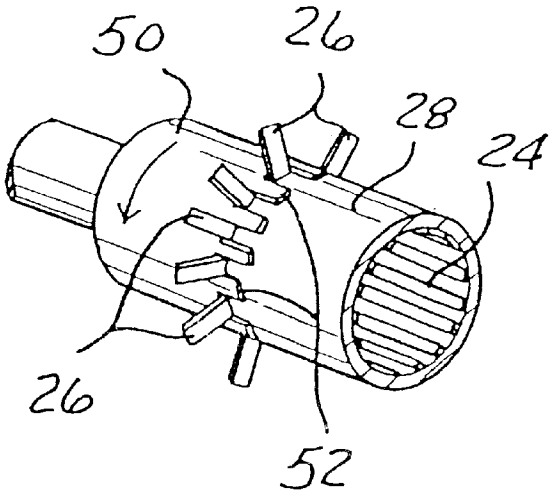
FIG. 7 PRIOR ART
FIG. 7 is a perspective view depicting another step in the construction method.

In the next step shown in FIG. 7, a tubular tool 50 having uniformly spaced, axially projecting teeth 52 on one end is engaged with the radially projecting tabs 26 projecting out of one end of the sleeve 28. The internal diameter of the tool 50 is such that it will have a loose, sliding fit with the outer diameter of the sleeve 28 and the teeth 52 are so spaced from each other so as to project through the spaces between the adjacent, radially projecting tabs 26.

When the tool 50 is seated with the teeth 52 between the radially projecting tabs 26, the first housing 30 is clamped or otherwise held against rotation and the tool 50 rotated coaxially of the sleeve 28 through a predetermined angle, which is typically from about 15° to about 45°. This action of the tool 50 rotatably offsets one end of the blank or sheet 20 from the previously fixed end held against rotation by the first housing 30 relative to the sleeve 28. The characteristics of the beryllium copper alloy of which the blank or sheet 20 is preferably made is such that, although the material possesses some resiliency, the rotation imparted by the tool 50 permanently sets the blank 20 in the rotated position.

Figure 8:
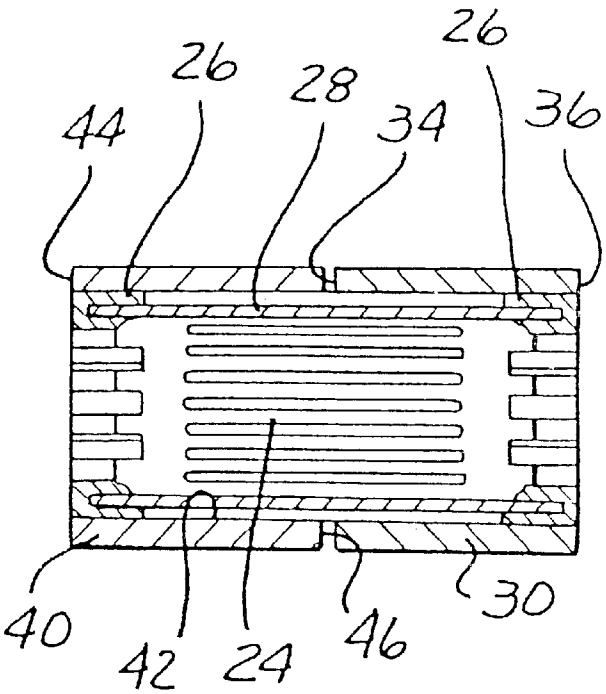
FIG. 8 PRIOR ART
FIG. 8 is a side elevational, longitudinal cross-sectional view of the final assembled state of the barrel terminal.

Next, as shown in FIG. 8, a second housing 40 also having a through bore 42 extending from a first end 44 to an opposed second end 46 is axially driven over the sleeve 28 into interference with the radially outward extending tabs 26 or the ends of the sleeve 28 and the blank 20 extending outward from the first housing 30 are axially driven into the bore 42 in the second housing 40. The second housing 42 is then advanced relative to the first housing 30 to force fit the interior surfaces of the bore 42 in the second housing 40 into engagement with the radially extending, angularly offset tabs 26 thereby bending the tabs 26 over into face-to-face engagement with the outer surface of the other end of the sleeve 28.

The second housing 40 and the first housing 30 are advanced relative to one another into near abutment to hold the angularly offset tabs 26 at each end of the sleeve 28 non-movably against the outer surface of the sleeve 28.

However, the above-described barrel socket or terminal has opposed open ends allowing access to the tabs 26 on the blank or grid 20 from either end to perform the above-described bending, inserting and locking operations.

According to one aspect of a barrel terminal useable in the present connector and shown in FIG. 9, a modified barrel terminal is mounted in a terminal housing 60 having a barrel terminal receiving portion or body 62 and a contiguous, generally axially or angularly spaced conductor or pin receiving portion 64. Thus, although the barrel terminal receiving portion or housing 62 is shown axially aligned with pin or conductor receiving portion or body 64, it will be understood that the two body portions 62 and 64, while contiguous or connected, can be disposed at any angular orientation, such as a 45 °, 90°, etc.

The barrel terminal receiving portion or body 62 has a first open end 66 which is hereafter defined as a "first or external end". A bore 68 extends from the first external end 66 to an internal wall 70, hereafter also referred to as a "blind end".

The pin receiving body 64 likewise has a first open end 72 and a through bore 74 extending from the first open end 72 to an internal wall 76. The bore 74 is configured for receiving a pin or conductor in an electrical connection.

In addition, the pin receiving body 64 can also be configured as part of an electrical use device, such as a battery wherein the body 64 is formed as an integral part of the battery within an internal electrical connection made by appropriate means to the body 64.

The terminal housing 60 shown in FIG. 9 can be produced from either stamped parts formed from flat metal stock and then formed into the desired cylindrical configuration or machined from metal bar stock.

A barrel terminal 80 constructed according to any one of several different methodologies is mountable in the bore 68 of the barrel terminal body 62.

As described in greater detail hereafter, the barrel terminal 80 is formed of a stamped grid having webs 82 and 84 at opposite ends of a plurality of interconnecting strips 86. Tabs 88 extend oppositely from the webs 82 and 84, respectively, and are secured in place to the barrel terminal body 62 by external end anchors and internal end anchors described hereafter. After the strips 86 have been angularly offset from end to end to dispose each strip in a hyperbolic shape from end to end having a smaller internal diameter at a generally center point than the nominal, non-hyperbolic state of the strips 82. This diameter is typically smaller than the outer diameter of a pin or conductor inserted into the barrel terminal 80 so as to provide a secure electrical contact between the barrel terminal and the inserted pin as well as a high pin pull-out retention force.

Alternately, the strips 86 of the barrel terminal 80 can be replaced by individual wires which are initially held in place by narrow neck portions or ribs between opposite ends of the wires which are separated during the hyperbolic angular offset process. The ends of each of the wires then act as the tabs for securement to the barrel terminal body 62 by the external and internal anchors described hereafter. Such a wire arrangement will also be understood to constitute a "grid" as the term is used herein. As also described hereafter, several aspects of the barrel terminal 80 may not require tabs at either the external or internal end of the barrel terminal 80.

Referring now to FIGS. 17–21, there are depicted the construction steps according to another aspect of a method for manufacturing an electrical connector utilizing a radially resilient socket.

Figure 17:
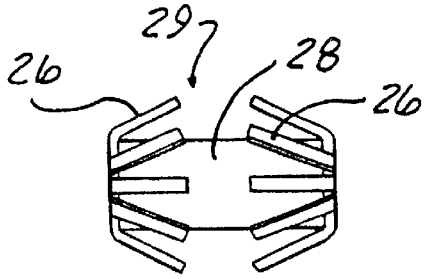
FIGS. 17–20 depict sequential steps in an alternate construction method of another aspect of a barrel socket.

In FIG. 17, the sleeve 28 is depicted. This construction stage is similar to that described above and shown in FIG. 4 in which the blank 20 has been bent or formed into a cylinder and the outer sleeve 28 disposed closely there over with the tabs 26 projecting outward from opposite ends of the sleeve 28 as shown in FIG. 3. However, in this method, the tabs 26 at both ends of the sleeve 28 are bent or folded around the outer ends of the sleeve 28 and back over the outer surface of the sleeve 28 to form a cartridge 29.

Figure 18:
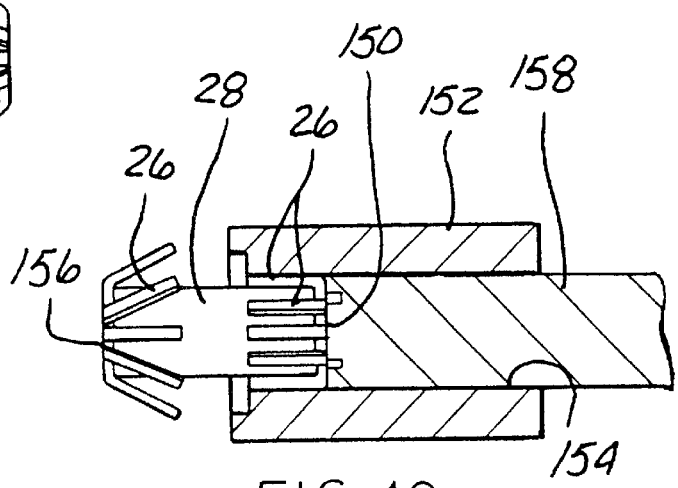

The first end 150 of the cartridge 29 is then inserted into a first housing or fixture 152 having a bore 154, as shown in FIG. 18. The inner diameter of the bore 154 is sized slightly larger than the outer diameter of the sleeve 28 by a distance equal to the thickness of the tabs 26 so as to closely fold over the tabs 26 into face-to-face engagement with the outer surface of the sleeve 28 when the first end 150 of the cartridge 29 is inserted into the first housing 152. It should be noted that the cartridge 29 is only partially inserted into the bore 154 in the first housing 152 such that the second end 156 of the sleeve 28 projects outwardly from the first housing 152 along with the tabs 26 at the second end 156 of the sleeve 28.

The first end 150 of the cartridge 29 is inserted into the bore 154 in the first housing 152 until the first end 150 engages one end of a rotatable tool 158 which is rotatably and axially movably disposed within the bore 154. The tool 158 can be similar to the tool 50 described above and shown in FIG. 7 and has teeth which engage the spaces between adjacent folded over tabs 26 at the first end 150 of the sleeve 28.

Figure 19:
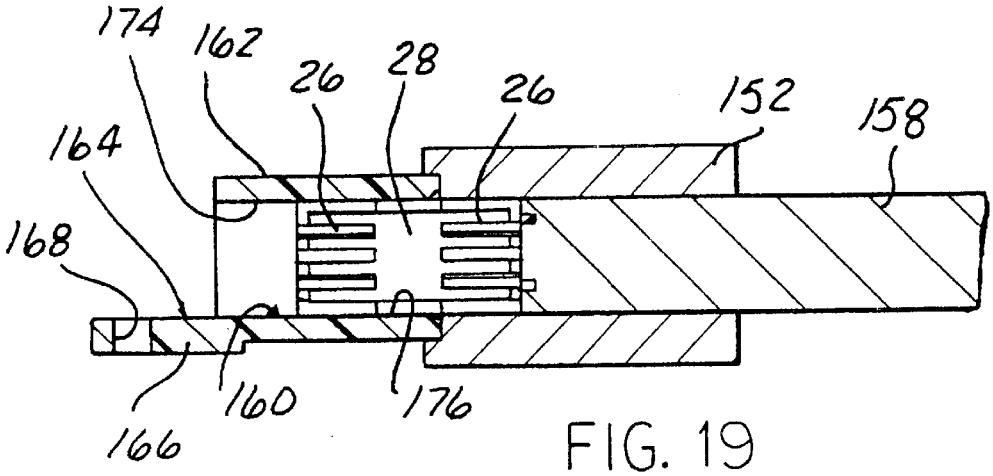

Next, as shown in FIG. 19, the second end 156 of the cartridge 29 is inserted into or otherwise brought into engagement with a bore 160 in a cylindrical portion 162 of a terminal, holder, support or electrical device, all referred to generally hereafter as a holder 164. The cylindrical portion 162 is disposed at one end of a support or base 166, the opposite end of which, by example only, includes an aperture 168 for receiving a fastener 170, shown in FIG. 21, to secure another terminal 172 carrying an electrical conductor, again by example only, to the holder 164.

The bore 160 in the cylindrical portion 162 can be divided into two sections, namely, a first end section 174 and a second end section 176. The inner diameter of the first end section 174 is selected to create a press or interference fit with the tabs 26 at the second end 156 of the cartridge 29 when the second end 156 of the cartridge 29 is inserted into the bore 160. The second end section 176 of the bore 160 has a larger diameter than the first end section 174 to enable the second end 156 and the folded tabs 26 on the outer sleeve 28 to pass freely there through into press-fit engagement with the first end section 174 of the bore 160. This forcibly mounts the second end 156 of the cartridge 29 in the cylindrical portion 162 of the holder 164 and brings the tabs 26 at the second end 156 of the outer sleeve 28 into secure electrical contact with the inner surface of the bore 160.

Figure 20:
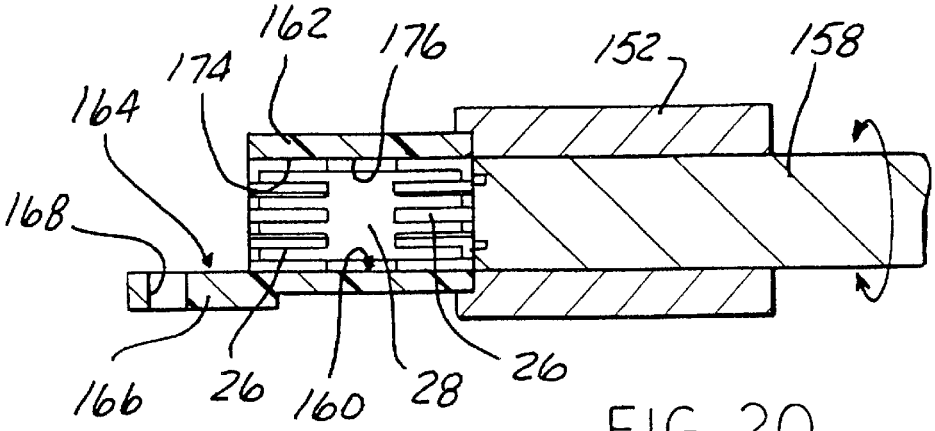

The cartridge 29 is forcible inserted into the bore 160 until the entire outer sleeve and folded over tabs 26 at the first end 150 of the cartridge 29 are fully enclosed within the bore 160 as shown in FIG. 20.

As described above, the second end section 176 of the bore 160 has a larger inner diameter than the adjacent first end section 174. This can be formed in a number of constructions, including a gradual decreasing diameter taper along the length of the bore 160 from the first end section 176 to the second end section 178.

Alternately, a step may be formed intermediate the ends of the cylindrical portion 162 to form two different diameter sections, one for the first end section 174 and the other for the second end section 176 of the bore 160.

As shown in FIG. 20, when the cartridge 29 is fully inserted into the bore 160, the second end 156 of the cartridge 29 and the folded over tabs 26 carried on the second end 156 are in a press-fit engagement with the inner surfaces of the cylindrical portion 162 surrounding the bore 160. However, the tabs 26 at the opposite end of the cartridge 29 will only be loosely disposed between the inner surfaces of the second end section 176 of the bore 160 and the adjacent outer surface of the sleeve 28.

The rotatable tool 158 can be advanced by a suitable drive source, such as a pressurized fluid cylinder, electric motor drive, etc., to slidably urge the first end 150 of the cartridge 29 and the folded over tabs 26 carried thereon from the first housing 156 into the bore 160 in the cylindrical portion 162 of the holder 164.

Next, as shown by the arrow in FIG. 20, the rotatable tool 158 is rotated to angularly offset the tabs 26 at the first end 150 of the cartridge 29 from the corresponding tabs 26 at the second end 156 of the cartridge 29. This provides the desired hyperbolic shape to the strips 24 between the webs 22 on the cylindrical blank as described above. With the rotatable tool 158 is held in the rotated position, the end portion of the cylindrical portion 162 of the holder 164 surrounding the second end section 176 of the bore 160 is subjected to a swaging operation which deforms the end portion of the cylindrical portion 162 and decreases its inner diameter to bring the inner diameter of the end portion of the cylindrical portion 162 into tight, close fitting engagement over the tabs 26 at the first end 150 of the outer sleeve 28 so that the tabs 26 are tightly held between and in contact with the outer surface of the sleeve 28 and the inner surface of the bore 160. The rotatable tool 158 is then withdrawn along with the first housing 152 leaving the completed connector denoted by reference number 180 in FIG. 21.

Figure 21:
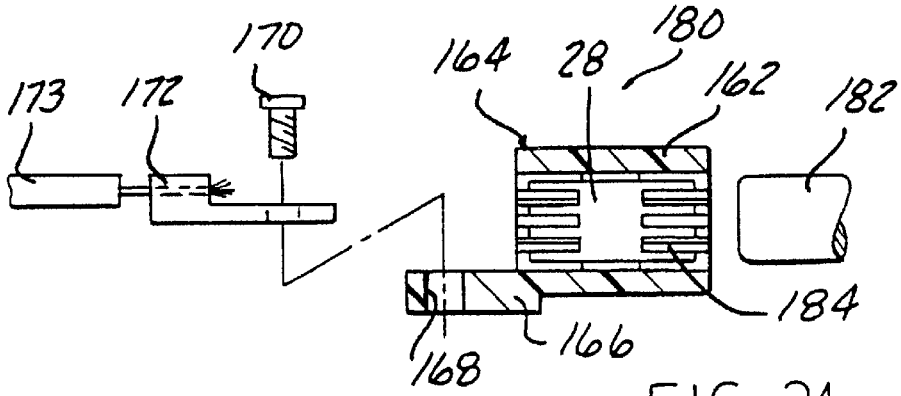
FIG. 21 is an exploded, partially cross section, side elevational view of the completed electrical connector constructed according to the method of FIGS. 21–24 shown in an interconnected use position.

As shown in FIG. 21, a terminal 172 carrying an electrical conductor 173 may be securely attached to the aperture 168 in the support 166 of the holder 164 by means of a threaded fastener or screw 170. Alternately, the holder 166 and the terminal 172 can be a unitary one piece member like the holder 62. An elongated, cylindrical pin 182 may be releasably inserted into the interior of the barrel socket 184 to couple the electrical device or circuit to which the pin 182 is attached with the circuit or conductors or electrical device to which the conductor 173 and terminal 172 are connected via the socket 184 and the holder 164.

In yet another method, the bore 160 is smooth, but sized for a press fit with the tabs 26. The cartridge 29 initially is inserted half way into the bore 160. Next, the tool 158 is rotated 15° to 45° to offset the tabs 26 and one end of the internal strips from the opposed tabs and the opposite end of the strips. The tool 158 then axially advances pushing the cartridge 29 fully into the bore 160 whereby the tabs 26 at both ends of the cartridge 29 are held in the angularly offset position through a press fit with the inner surface of the bore 160.

Figure 23:
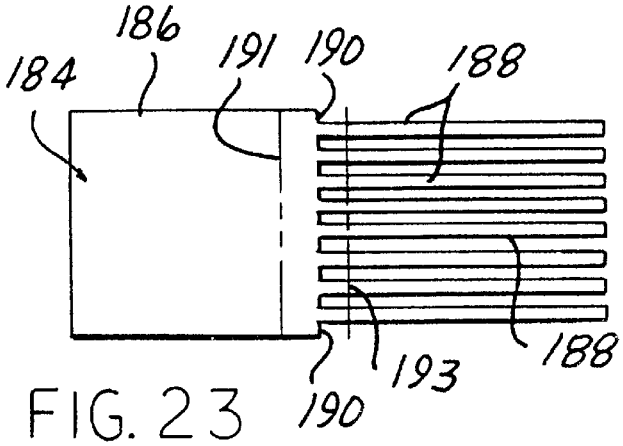
Figure 24:
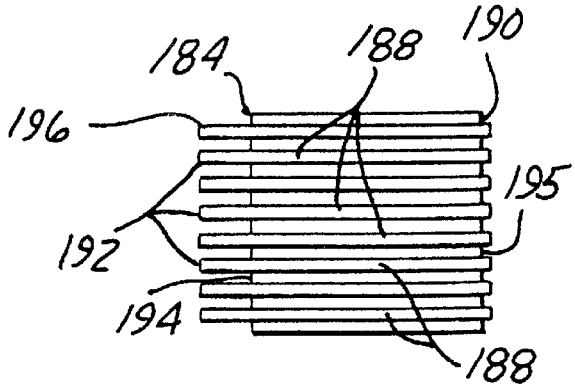
Figure 25:
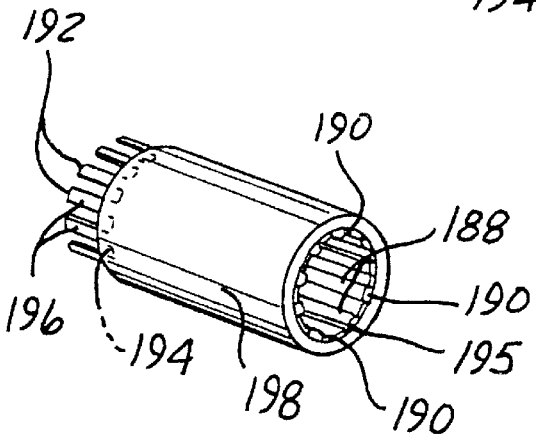
FIG. 25 is a perspective view showing multiple means for fixedly mounting the tabs of the contactor to the sleeve.

An alternate method of constructing the blank 20 and outer sleeve 28 described above and shown in FIGS. 1–4 as a unitary, one piece member is depicted in FIGS. 23–25.

In this aspect, a one piece sheet metal blank 184 is formed with a first generally rectangular, solid end portion 186 and a plurality of elongated, generally flat strips 188 which extend longitudinally from one end of the solid end portion 186 and are equally spaced apart and disposed in parallel. The entire blank 184 may be formed of a suitable electrically conductive material, such as beryllium copper. The strips 188 are unitarily joined to one end of the solid end portion 186 at a first end 190 by welding or as a unitary stamping with the solid portion 186. Alternately, the strips 188 maybe joined to the blank 186 along lines 191 or 193 with suitably formed end portions on the strips 188 or the blank 186.

Next, all of the strips 188 are bent or folded over the second end 195 of the solid end portion 186 about the first end 190 and remain in parallel as shown in FIG. 24. As shown therein, the free ends 192 of each of the strips 188 extend beyond a first end 194 of the solid end portion 186. The portion of the strips 188 projecting beyond the first end 194 form tabs 196.

Next, as shown in FIG. 25, the solid end portion 186 is then folded into a cylindrical sleeve 198 and the edges welded or otherwise fixedly joined together. The folding operation carries the strips 188 overlaying one surface of the solid end portion 186 such that the strips 188 are now disposed within the interior of the resulting cylindrical sleeve 198 as shown in FIG. 25. The tabs 196 still project outward beyond the first end 194 of the sleeve 198.

At this point in the construction of the sleeve 198, the second end 195 may be inserted into tight engagement with a bore in a holder, as described above. The tabs 196 may be folded over the outer surface of the sleeve 198 and secured in the bore of a holder as described above and shown in FIG. 9, after the angular offset is imparted to one end of the strips 188, by either of the previously described construction methods.

FIG. 22 depicts three different attachment locations or methods for attaching the tabs 196 or an end portion of the tabs 196 or the strips 188 to the outer sleeve 198. All three are depicted in a single sleeve 198 merely for convenience, it being understood that in an actual construction, one or more of the attachment methods could be employed for all of the strips 188 and tabs 196 in a single connector.

The different attachment methods share a common feature in that the tabs 196 or end portions of the strips 188 are fixedly secured to the sleeve 198 by welds. Since the weld cannot increase the thickness of the tab 196 or strip 188, a slight depression or aperture 200 can be formed at the end portion of the tabs 196 or strips 188 at the location of each weld.

Thus, according to one aspect, the tabs 196 are folded over the first end 194 of the sleeve 198 as in the above described embodiments of the invention and then welded to the outer surface of the sleeve 198. Alternately, the tabs 196 can be shortened so as to define a portion 202 which has a length only foldable over the first end 194 of the sleeve 198.

According to another aspect of the present invention, the strips 188 are formed without any tabs 196 such that the strips 188 terminate in an end 204 within the bore in the sleeve 198 adjacent to the first end 194 of the sleeve 198.

Regardless of which construction technique is employed, the end result is that the strips 188 are maintained in parallel at the first end 194 of the sleeve 198 and fixedly secured thereto after the freely movable end portions of the strips 188 at the first end 194 of the sleeve 198 have been rotated the desired amount as in the construction methods described above.

The following description will encompass several different aspects of an external grid anchor used to fixedly mount one end of the barrel terminal 80 in a fixed position relative to the barrel terminal body 62 after the hyperbolic angular offset is applied to the strips 86 of the barrel terminal 80 which is only partially illustrated in the following figures.

Figure 10:
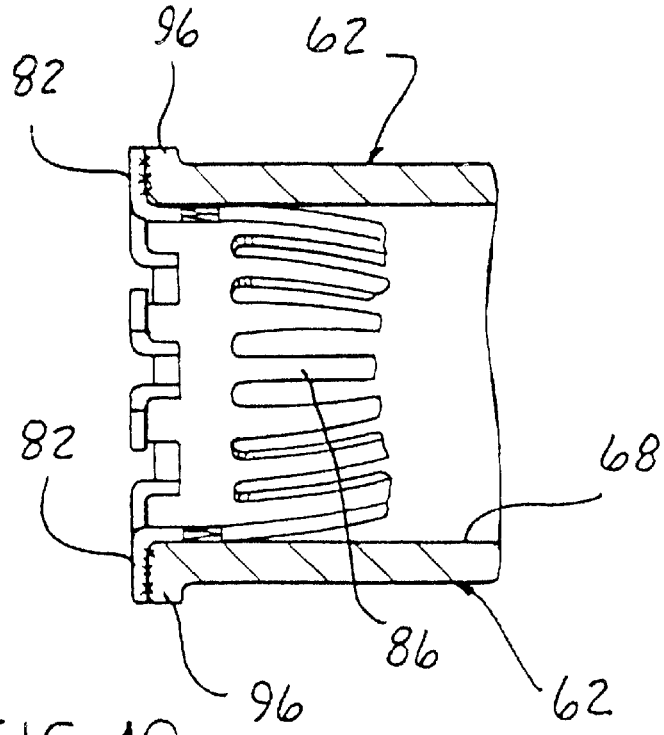
FIG. 10 is a partial, longitudinal cross-sectional view of one aspect of an external grid anchor for the barrel terminal shown in FIG. 9.

As shown in FIG. 10, in one aspect, the external end 96 of the barrel terminal body 62 is flared outward in an annular flange. The tabs 88 at the external end of the barrel terminal 80 are either pre-bent or bent radially outward after the barrel terminal 80 is inserted into the bore 68 in the barrel terminal body 62. The radially disposed tabs 88 are fixedly secured to the exterior surface of the flange 96 by suitable means, such as by welding. Although low temperature brazing or soldering could also be employed to fixedly secure the tabs 88 to the flange 96, either ultrasonic or impulse (capacitor-discharge) welding processes may be better suited for the typical beryllium-copper construction of the grid of the barrel terminal 80 since these processes generate only momentary, localized heating which is confined to the touching surfaces of the tabs 88 and the flange 96 thereby resulting in little adverse effect on the metal properties of the remainder of the grid or the barrel terminal 80.

Figure 11:
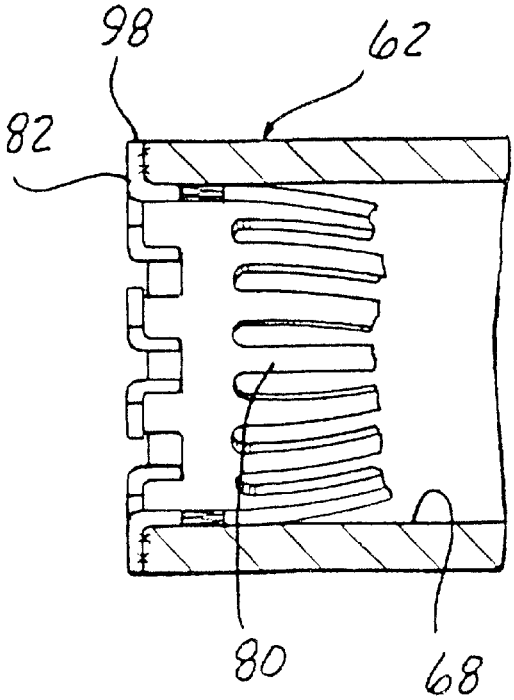
FIG. 11 is a partial, longitudinal cross-sectional view of another aspect of an external grid anchor for the barrel terminal shown in FIG. 9.

The external grid anchor shown in FIG. 11 is similar to the external grid anchor described above and shown in FIG. 10, except that the external end of the barrel terminal body 62 does not include the radially extending flange 96. Rather, the external end 98 of the barrel terminal body 62 is merely an axial end of the body sidewall. The tabs 88 are still radially outwardly bent or pre-formed so as to wrap around and engage the external end 98. The tabs 88 are then fixed to the end 98 by welding as described above. Dimples, not shown, are formed on the facing surface of one of the tabs 88 or the end of the body 62 for forming the weld.

In the aspect of the external grid anchor shown in FIG. 12, the overall length of the barrel terminal 80 is such that the tabs 88 or merely the ends of the strips 86 forming the grid of the barrel terminal 80 are angularly disposed in a pre-stressed shape to exert a radially outward contact force against an inner surface 116 adjacent the inner surface of the end 102 of the barrel terminal body 62. The tabs 88 are fixed in place after the angular offset is formed between the ends of the grid strips in the barrel terminal 80 by suitable welding processes, such as ultrasonic welding, impulse-capacitor-discharge welding or possibly low-temperature brazing or soldering.

Figure 13:
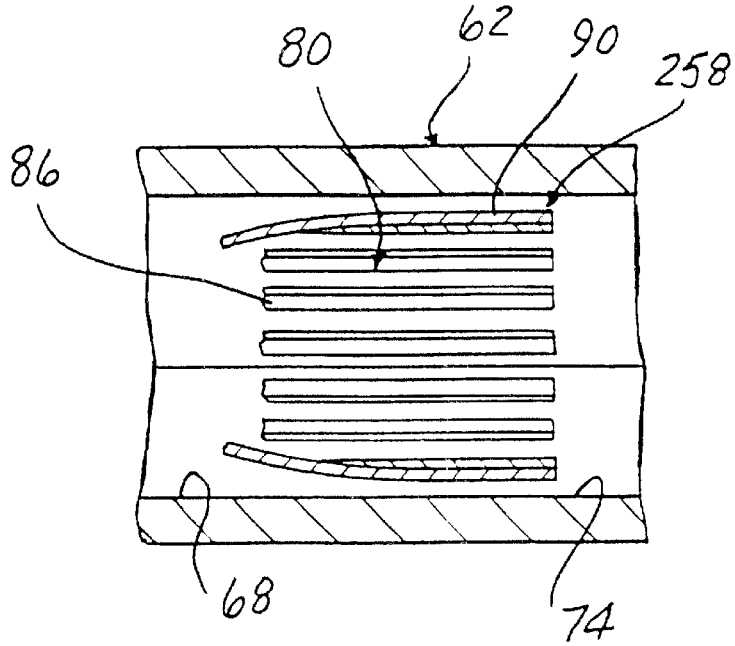
FIGS. 13 and 14 are partial, enlarged, longitudinal cross-sectional views showing another aspect of an internal anchor in a partially assembled and completely assembled state, respectively.
Figure 14:
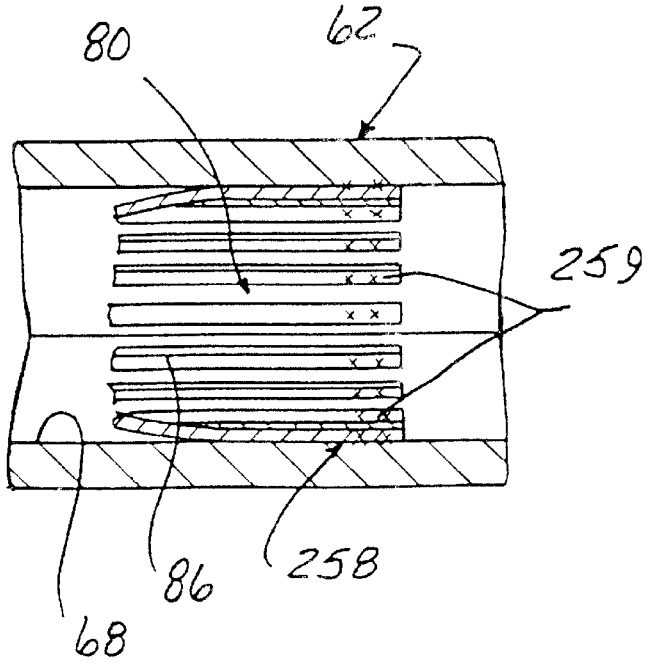

An internal grid anchor 258 depicted in FIGS. 13 and 14 is used to anchor or fix the inner end of the barrel terminal in a holder. The internal grid anchor 258 requires a terminal body 62 in the form of a hollow cylindrical form made from flat stock which is then formed or bent into a cylindrical configuration with oppositely extending bore portions 68 and 74. In the anchor 258, the barrel terminal 80 has the tabs 90 or ends of the strips 86 disposed generally in line with the strips 86 and not at any significant inward extending, pre-formed angle. The flattened grid containing the strips 86 or individual wires forming the strips 86 are secured by an internal grid anchoring technique employing welds shown by reference number 258 at the internal end of each strip 86. Welding or joining processes must be selected so that the metal properties of the grid of the barrel terminal 80 or the entire terminal body 62 are not adversely effected by the process heat or pressure. Suitable joining processes can include ultrasonic welding, impulse/capacitor-discharge welding, and low-temperature brazing/soldering.

After the internal ends or tabs 90 of the strips 86 of the barrel terminal 80 have been welded to the inner surface of the terminal housing 60, the terminal body 62 is formed into the cylindrical shape with the opposed side edges fixedly joined together, by interlocking mechanical connection, welding, etc.

Figure 15:
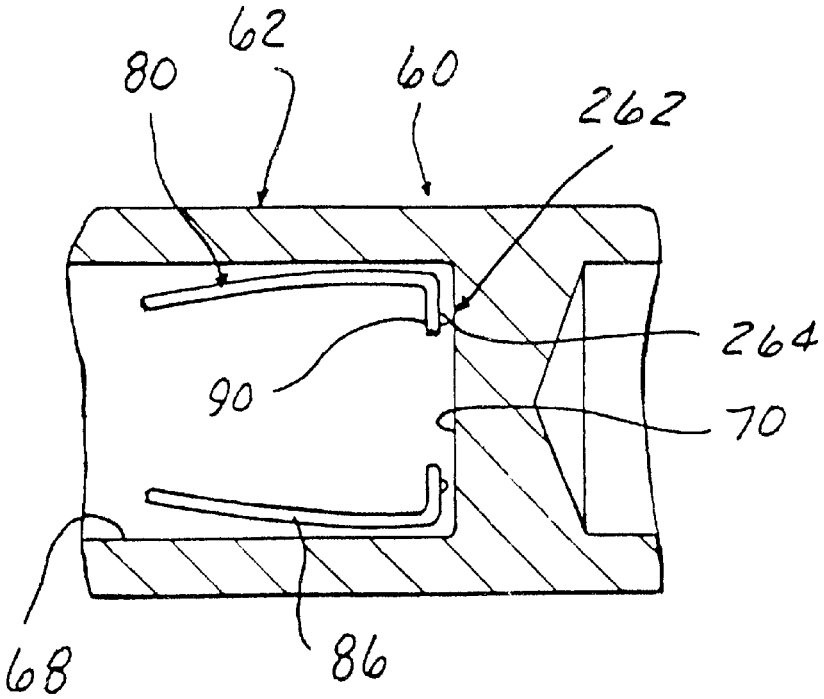
FIGS. 15 and 16 are partial, enlarged, longitudinal cross-sectional views showing another aspect of an internal anchor in a partially assembled and completely assembled state, respectively.
Figure 16:
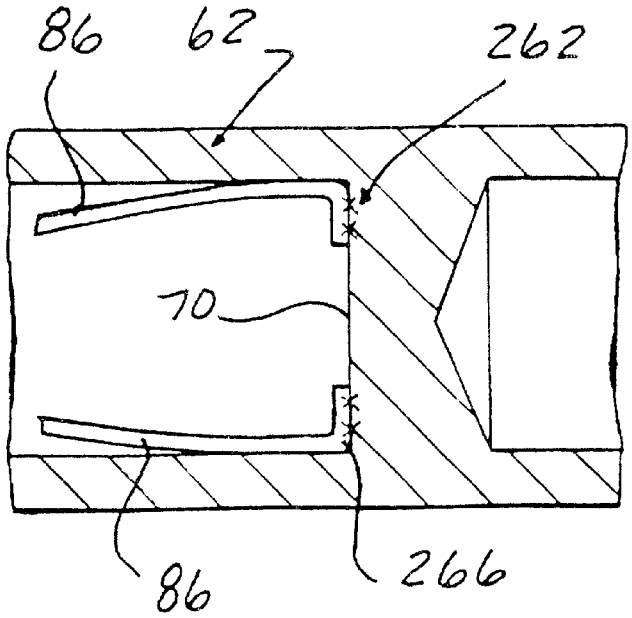

In FIGS. 15 and 16, yet another internal grid anchor 262 is depicted. The internal grid anchor 262 is suited for use with the barrel terminal body 62 described above and shown in FIG. 9. The barrel terminal 80 has the tabs 90 at the ends of the strips 86 pre-formed or bent into an angular, generally perpendicular orientation. The barrel terminal 80 may also be formed of individual strips which are not initially provided in an integral, web connected, grid configuration.

The internal grid anchor 262 includes projections or contact points 264 formed on an outer surface of each projection 90 facing the internal wall 70 in the bore 68. The projections 264 are at right angles to the axis of the bore 68 and are readily accessible to welding equipment through the bore 68. The common plane array of the projections 268 greatly facilitates "gang-welding" of the projections 264 to the internal wall 70 of the barrel terminal housing 62 as shown by the welds 266 in FIG. 16.

Figure 26:
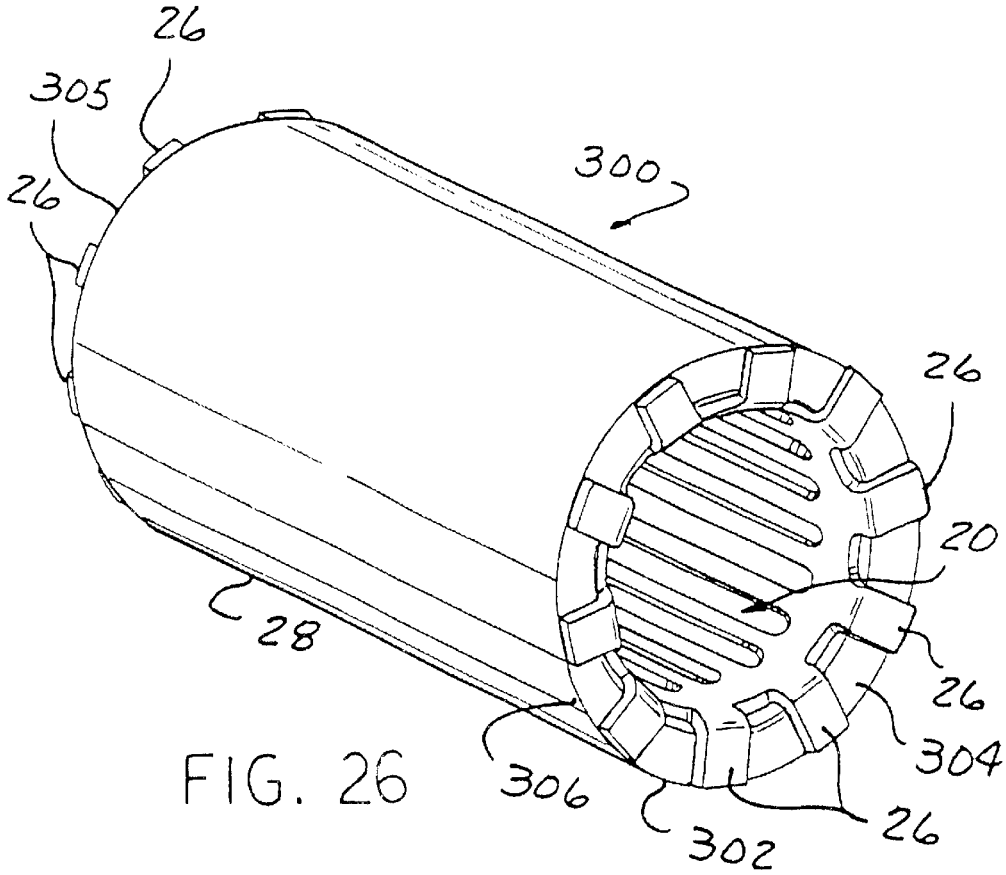
FIG. 26 is a perspective view of another aspect of an electrical connector.
Figure 27:
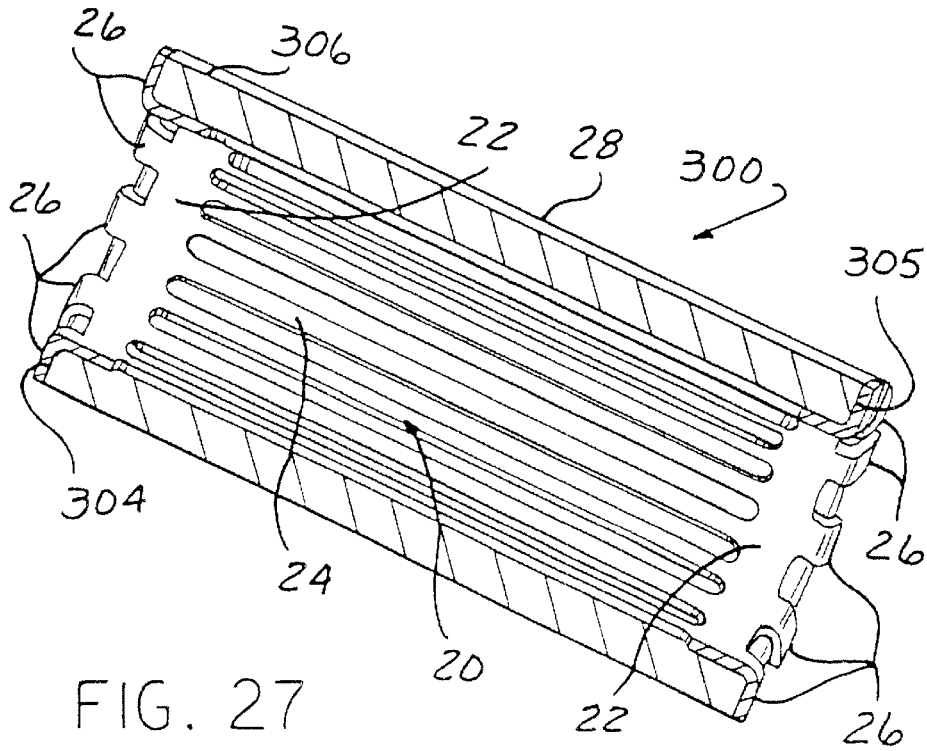
FIG. 27 is a longitudinal, cross-sectional view of an electrical connector shown in FIG. 26, with the grid inserted into the sleeve, but before the angular offset as applied to the grid strips.

Referring now to FIGS. 26 and 27, there is depicted an electrical barrel socket 300 constructed in accordance with another method. The socket 300 is formed as a cartridge which can be mounted in a use element, as described above.

The socket 300 includes a contactor or grid, such as the grid 20 described above and shown in FIG. 1. The grid 20, which may initially be formed as a flat blank, is formed or bent into a cylindrical, tubular shape as shown in FIG. 2 and inserted into a cylindrical, concentric outer sleeve 28 as shown in FIG. 3.

In this aspect of the invention, the tabs 26 projecting from the webs at each end of the grid 20 are formed with a length to be disposed in a predetermined position with respect to one end 302 of the sleeve 28, the outer side end wall 304 of the sleeve 28, or in a wrap around configuration over the outer end surface 306 of the sleeve 28, all of which are depicted in FIG. 25. Thus, by way of example only, the tabs 26 are depicted as having a length which allows each tab 26 to be bent radially outward from the cylindrical, axially extending shape shown in FIG. 3 over and in close proximity or contact with the end wall 304 of the sleeve 28. The tabs 26 are fixedly secured to the end wall 304 of the sleeve 28 by welding, such as ultrasonic welding, spot welding; impulse-capacitor discharge welding or, possibly, low-temperature brazing or soldering.

In the same manner as shown in FIG. 26, the tabs 26 could also be welded to the inner surface of the sleeve 28 adjacent the end wall 304 or provided with a longer length and wrapped around the end portion 306 of the outer surface of the sleeve 28 as shown by reference number 196 in FIG. 25 and then welded to the exterior surface 306 of the sleeve 28.

The angular offset or rotation, as described above, is applied to the tabs 28 at the other end of the grid 20 before the tabs 26 at the opposite end of the grid 20 are fixedly secured by any of the welding methods described above to either the interior end surface, the opposed end wall 305 or the exterior end surface 306 of the sleeve 28.

The above described socket 300 affords a compact socket in a cartridge form which can be mounted in a bore in a use element for receiving an electrical conductor or pin in a smooth, slide-in connection. The hyperbolic arrangement of the strips 24 in the grid 20 between the opposed webs 22 of the grid 20 assure secure electrical contact with the inserted conductive member as well as affording a high friction force resisting conductor or pin pull-out from the socket 300.

Figure 28:
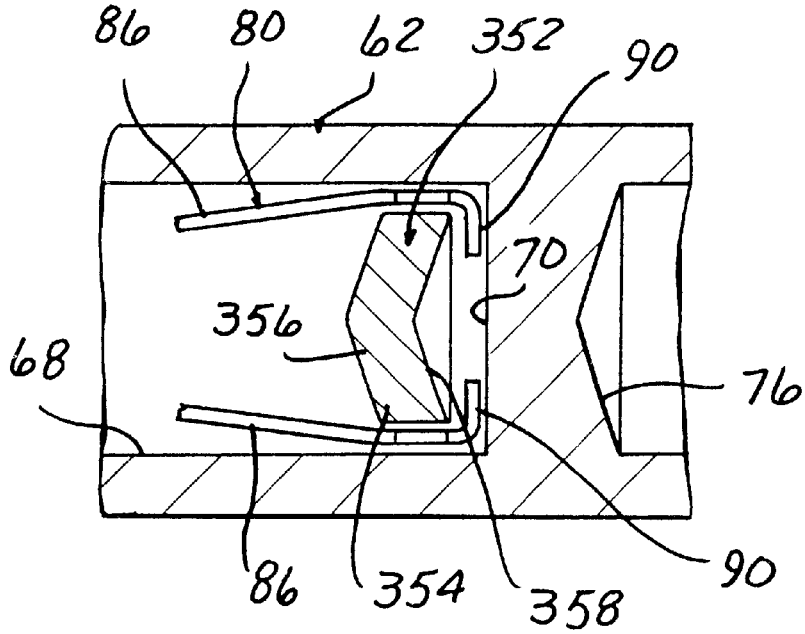
FIGS. 28 and 29 are partial, enlarged, longitudinal cross-sectional views showing another aspect of an internal anchor shown in partially assembled and completely assembled states, respectively.
Figure 29:
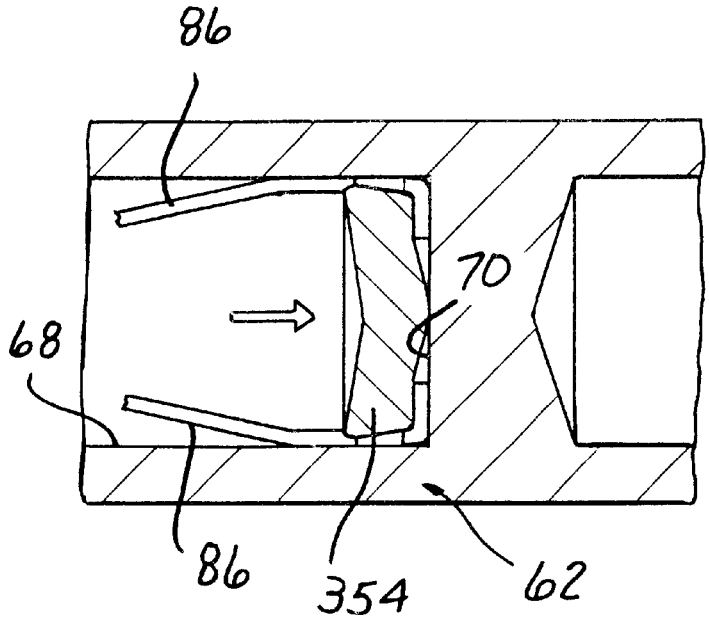

Referring now to FIGS. 28 and 29, there is depicted another aspect of an internal or blind end anchor 352 useable in the socket shown in FIG. 15. The anchor 352 is in the form of a conically shaped, annular disc 354 which is preferably formed of a material softer than the material used to form the barrel terminal body 62. As shown in FIG. 28, the disc 354 has a V-shape formed with opposed first and second V-shaped walls 356 and 358.

In this aspect, the tabs 90 are initially pre-bent into an angular or perpendicular shape with respect to the remainder of the strips 86 so as to seat against the internal wall 70 in the bore 68 in the barrel terminal body 62. After the barrel terminal 80 has been inserted into the bore 68, with the tabs 90 disposed adjacent to the internal wall 70, force, by a punch or other tool member inserted into the bore 68 internally of the strips 86 of the barrel terminal 80, is applied in the direction of the arrow in FIG. 29 against the first surface 356 of the disc 354 to deform the V-shaped disc 354 into a generally flat or planar shape shown in FIG. 29. This displaces the softer material of the disc 354 radially and axially outward away from the direction of the applied forced so as to compressively trap the tabs 90 on the barrel terminal 80 against the inner wall 70 and the adjacent sidewalls of the bore 68 as shown in FIG. 28.

Figure 30:
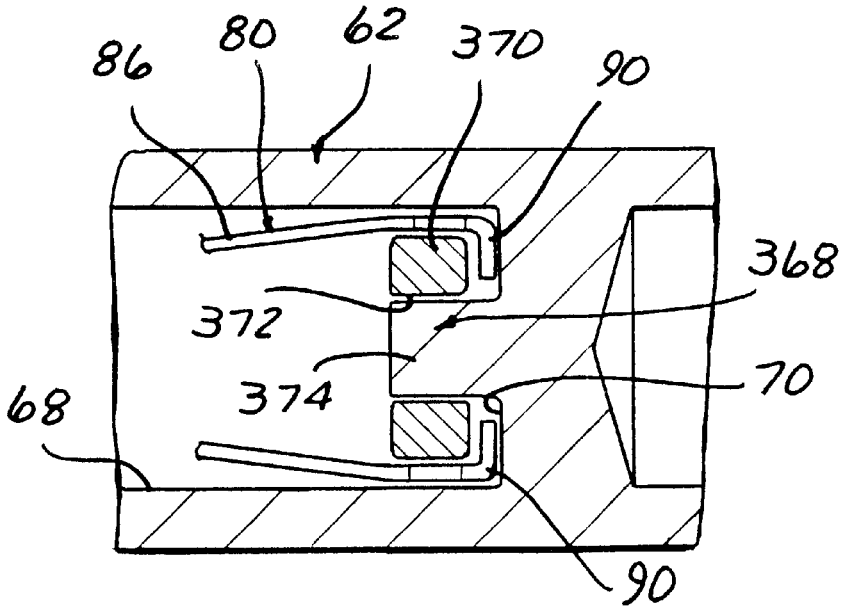
FIGS. 30 and 31 are partial, enlarged, longitudinal cross-sectional views showing another aspect of an internal anchor shown in partially assembled and completely assembled states, respectively.
Figure 31:
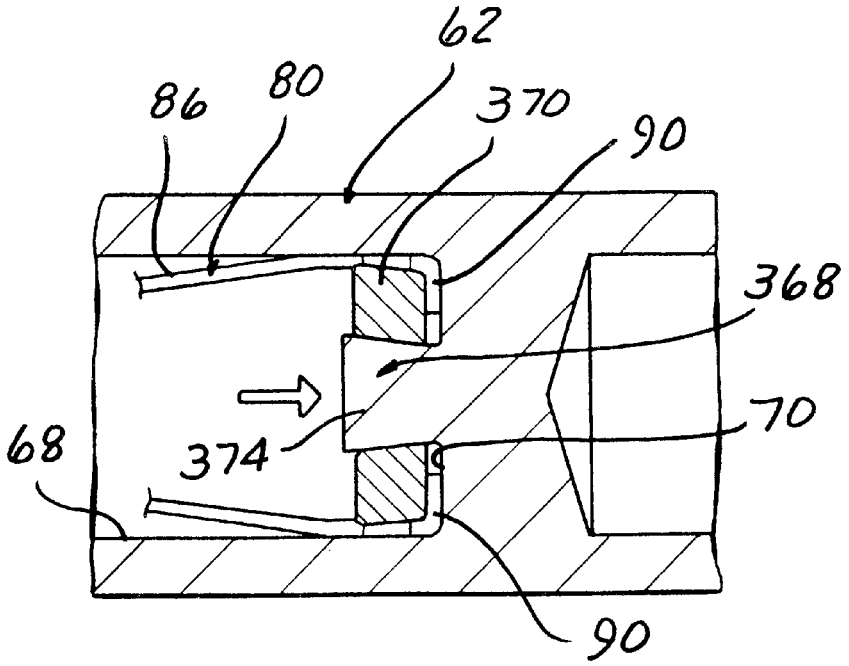

In FIGS. 30 and 31, a different internal grid anchor 368 is depicted. In this aspect of the invention, the internal grid anchor 168 includes a generally flat washer 370 having an central bore or aperture 372 formed therethrough. The aperture 372 in the washer 370 receives a nib or projection 374 which is an integral extension of a solid portion of the barrel terminal body 62 which forms the internal wall 70. The nib 374 initially has a generally cylindrical shape and a diameter to allow the nib 374 to extend easily through the central bore 372 in the washer 370.

Figure 36:
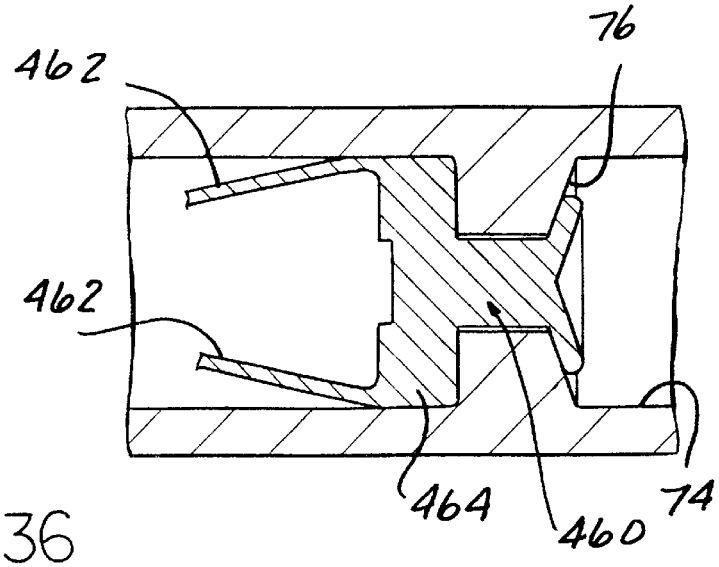
FIG. 36 is a partial, enlarged, longitudinal cross-sectional view showing another aspect of an internal anchor.
Figure 37:
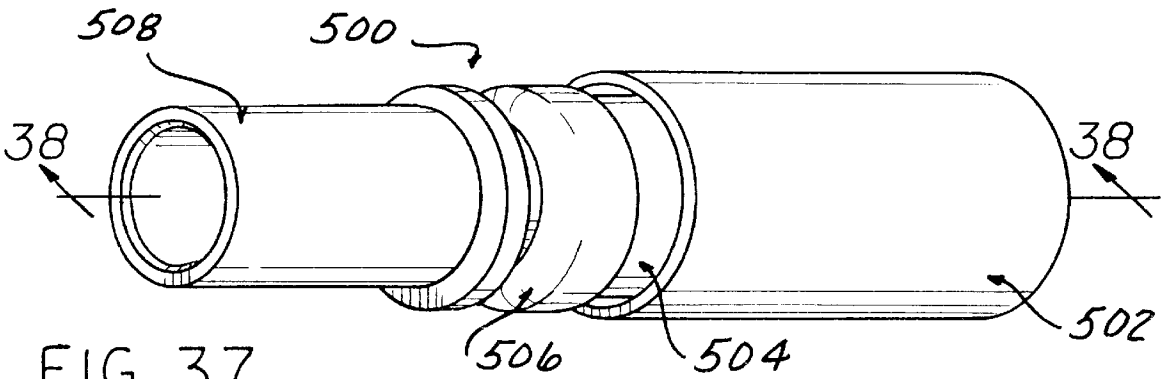
FIG. 37 is a perspective view of an electrical connector constructed in accordance with the teachings of the present invention.

During the assembly process, after the barrel terminal 80 has been inserted into the bore 68 in the barrel terminal body 62, with or without the tabs 90 on the strips 86 of the barrel terminal 80 being angularly bent with respect to the remainder of the strips 86, a force is applied in the direction of the arrow in FIG. 36 to the outer surface of the nib 374. This results in outward expansion of the material of the nib 374 causing the nib 374 to mushroom radially outward thereby forcing the perimeter of the washer 370 to expand locking the adjacent portions of the tabs 90 or strips 86 to the walls of the barrel terminal body 62 as shown in FIG. 31. This radially outward mushrooming of the nib 374 also causes a radial expansion of the outer end surface of the nib 374 over an adjacent portion of the washer 370 adjacent to the bore 372 in the washer 370. This interference prevents linear pull-out of the washer 370 and the barrel terminal 80 from the body 62.

Figure 32:
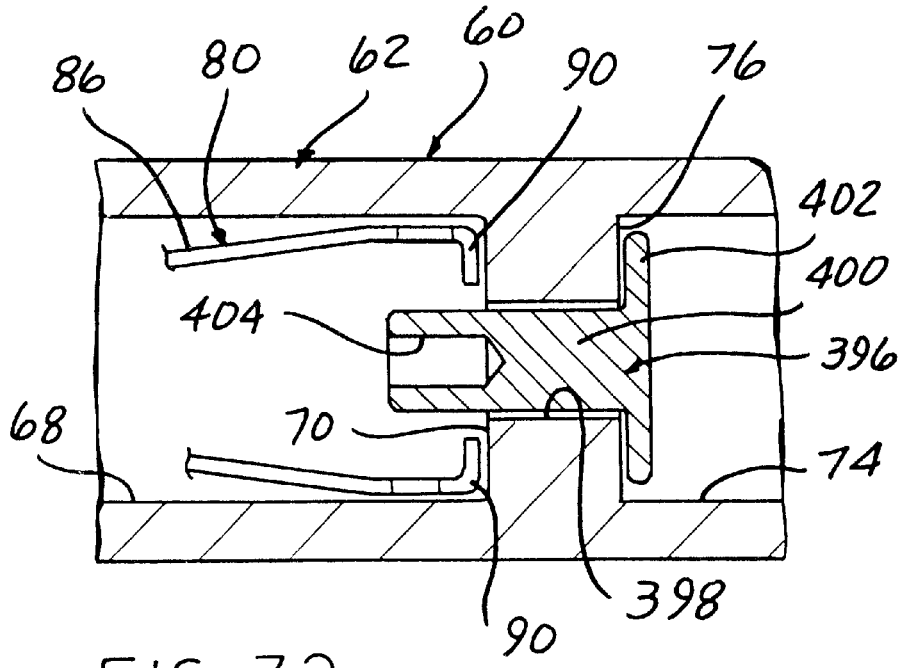
FIGS. 32 and 33 are partial, enlarged, longitudinal cross-sectional views showing another aspect of an internal anchor in partially assembled and completely assembled states, respectively.

Another aspect of an internal grid anchor 396 is depicted in FIGS. 32 and 32. The anchor 396 is usable in connector applications where the material forming the barrel terminal body 62 is not malleable enough to enable deformation of the integrally formed nib, such as nib 368.

Figure 33:
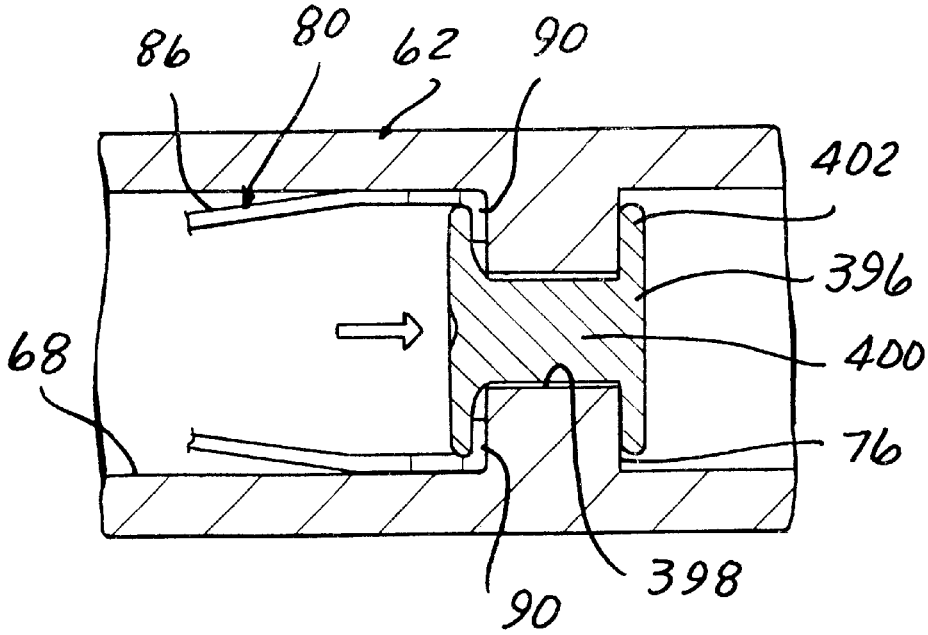

In this application, a bore 398 is formed through the central solid portion of the terminal housing 60 between the internal wall 70 and the opposed internal wall 76. A cylindrical rivet-like body 400 has an enlarged end flange 202 at one end. The body 400 is inserted through the bore 398 with the enlarged end flange 402 disposed adjacent to the internal wall 76 in the bore 74 in the terminal housing 60. The other end of the body 400 has a counterbore 404 which extends axially away from the internal wall 70 beyond the tabs 90 on the ends of the strips 86 of the barrel terminal 80. A compressive force applied by a punch or die, not shown, in the direction of the arrow in FIG. 33 in the counterbore 404 deforms one end of the malleable body 400, while the other flange 402 end of the body 400 is held in a fixed position against the inner wall 76. This results in deformation of the end of the body 400 radially outward into a rivet-like mechanical interlock connection between the tabs 90 and the adjacent ends of the strips 86 of the barrel terminal 80 locking the barrel terminal 80 in contact with the inner wall of the barrel terminal body 62.

Figure 34:
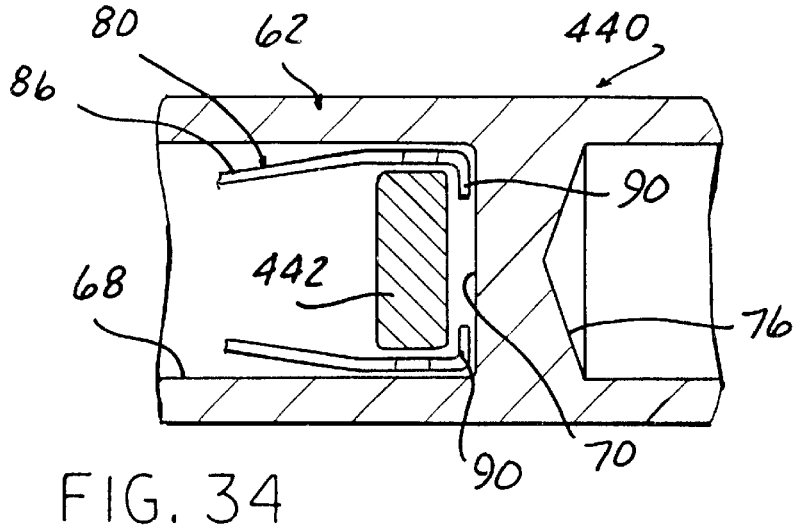
FIGS. 34 and 35 are partial, enlarged, longitudinal cross-sectional views showing another aspect of an internal anchor in partially assembled and completely assembled states, respectively.
Figure 35:
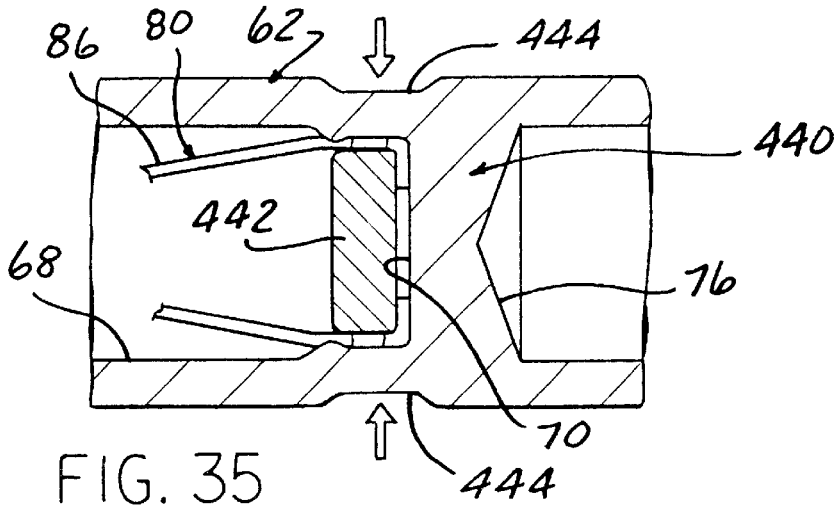

An internal grid anchor 440 shown in FIGS. 34 and 35 includes an annular, generally flat disc or washer 442 inserted into the bore 68 in the barrel terminal body 62. An external compressive, circumferential force shown by the arrows in FIG. 35 is applied to the exterior surface of the barrel terminal body 62 generally at the location of the washer 442. These forces result in a depression 444 which results in deformation of the metal forming the sidewall of the barrel terminal body 62 to mechanically interlock the tabs 90 and/or ends of the strips of the barrel terminal 80 with the washer 442 and the sidewall of the bore 68 of the barrel terminal body 62.

In FIG. 36, a rivet-type joining technique is employed to fixedly secure an anchor 460 to the inner wall 76 of the bore 74. However, in this aspect of the invention, the contact wires 462 are joined or welded to the opposite or outer surface of an annular disc 464. In this aspect, the contact wires 462 are not wrapped around the periphery of the annular disc 464; but could be.

Referring now to FIGS. 37–40, there is depicted an electrical connector 500 constructed in accordance with the teachings of the present invention. Generally, the electrical connector 500 includes a holder 502, an electrically conductive barrel socket 504, a pull-out force resistance means 506 and a conductive end form, such as a 508. The barrel socket 504 is depicted, by example only, as being constructed according to the method and structure shown in FIGS. 1–8 and described above. It will be understood that the barrel socket 504 may take other forms, such as any of the barrel socket constructions described above and shown in FIGS. 1–38.

As shown in FIGS. 37–40, the barrel socket 504 is mounted in the holder 502 in a bore 510 extending from a first end 512 of the holder 502. The barrel socket 504 is preferably fixedly and non-rotatably mounted in the bore 510 in the holder 502 by suitable means, such as by a press or interference fit created by inward tapering sidewalls forming the bore 510. A shoulder 514 is formed internally of the holder 502 at one end of the bore 510 and functions as a seat to limit the insertion of the barrel socket 504 into the bore 510.

The opposed end 516 of the holder 502 may take a variety of shapes depending on the particular application in which the electrical connector 500 is employed. Thus, it will be understood that the illustrated generally tubular shape for the holder 502 is by way of example only as the end 516 of the holder 502 may be part of a use element.

In the depicted structure, a bore 518 extends axially from the end 516 and is depicted as being in communication with the bore 510 through an intermediate, reduced diameter intermediate bore 520. The bores 518 and 520 may be sized to slidably receive a pin which is inserted into the inner end of the barrel socket 504 mounted in the bore 510 of the holder 502. Alternately, at least the bore 518 may receive the stranded or bare ends of a stranded electrical conductor which are stationarily fixed in the holder 502 by solder, crimping, or other conventional electrical joining techniques.

Figure 38:
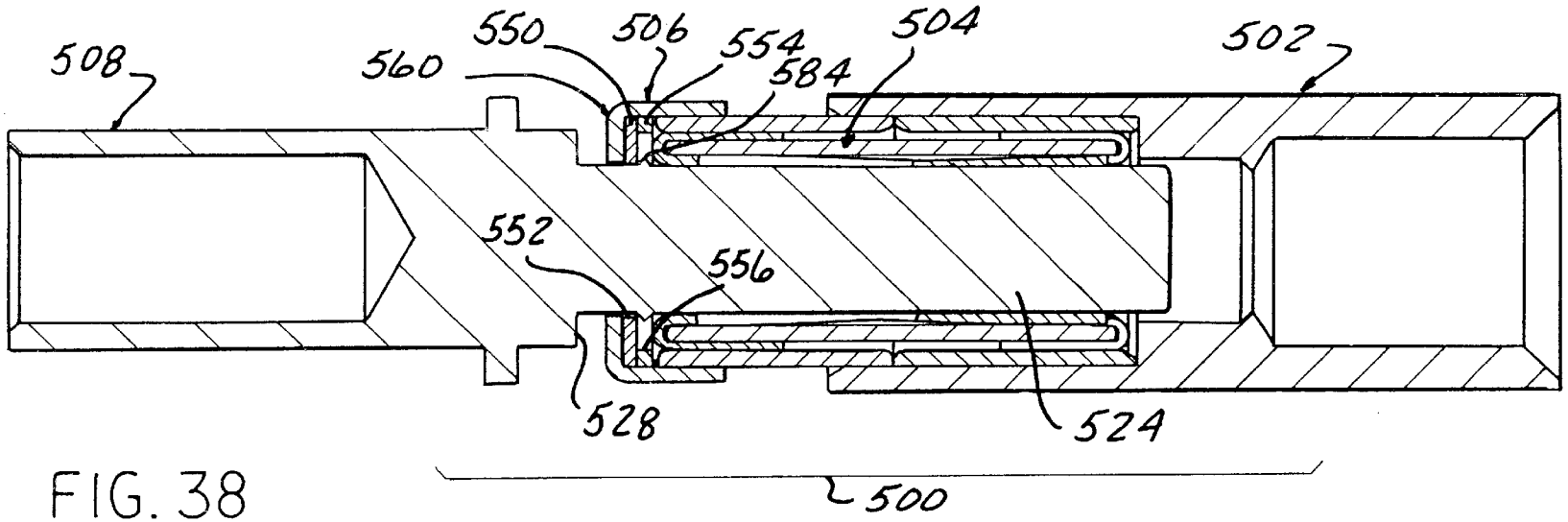
FIG. 38 is a cross-sectional view generally taken along lines 38—38 in FIG. 39.
Figure 39:
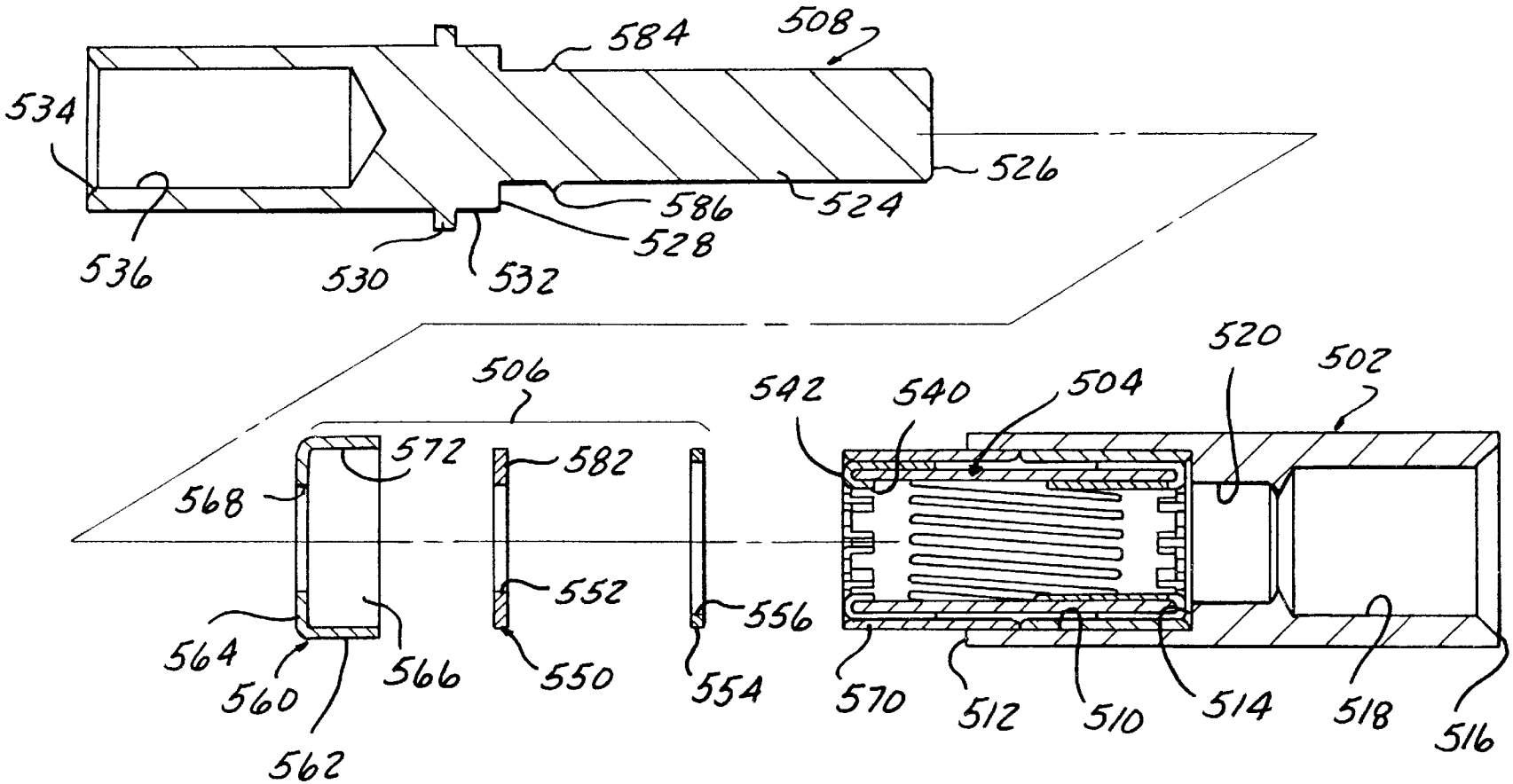
FIG. 39 is an exploded, side elevational view, similar to FIG. 40, but showing the components of the electrical connector of the present invention in a partially assembled state.
Figure 40:
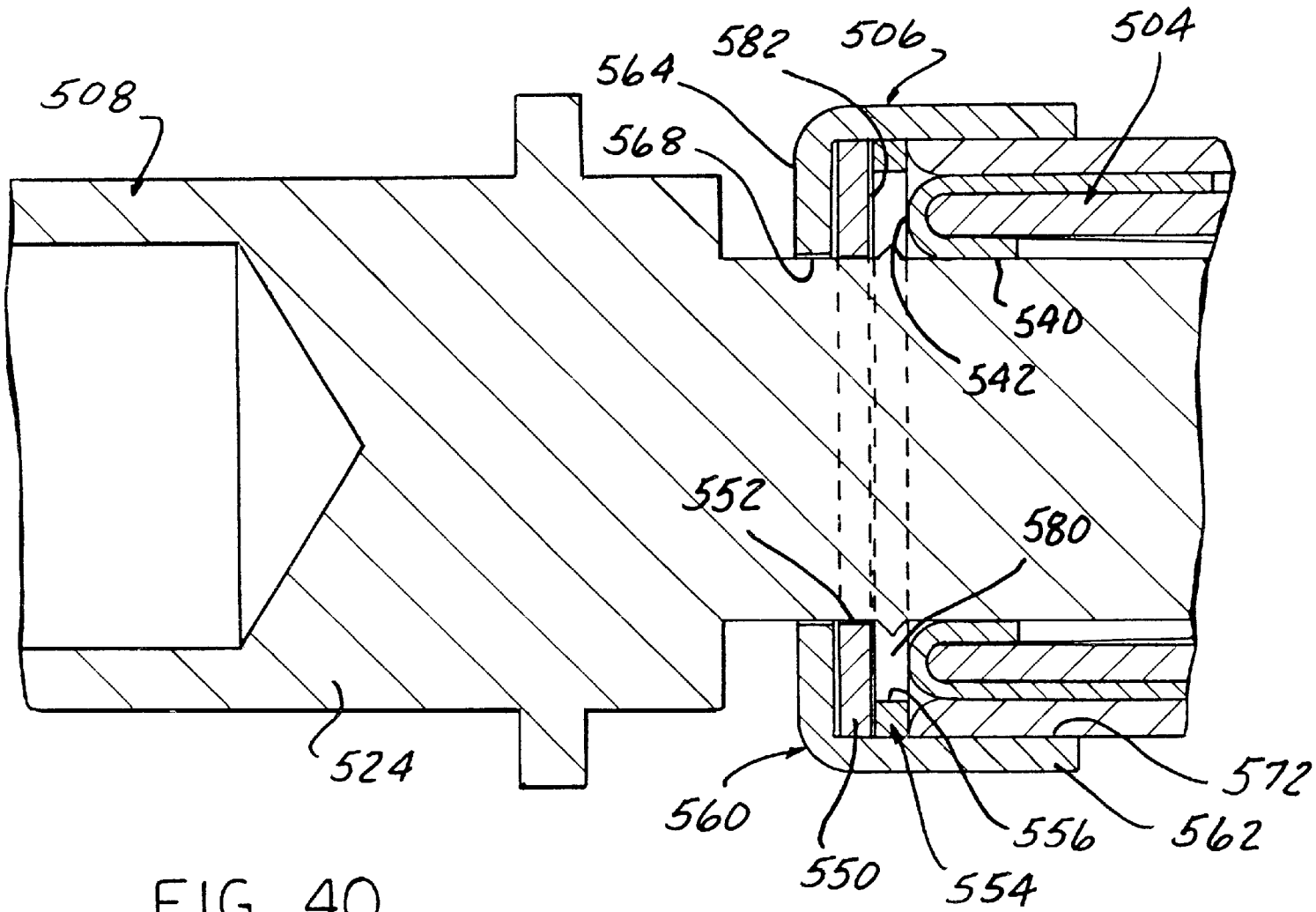
FIG. 40 is an enlarged, side elevational view of the electrical connector shown in FIG. 39, depicted in a latched state.

Similarly, the conductive end form 508 may take a variety of shapes depending upon the particular application of the electrical connector 500. Thus, the end form 508 is shown in FIGS. 38–40, by way of example only, as having an elongated pin 524 extending from a first end 526 to an intermediate shoulder 528. A radially enlarged flange 530 projects radially outward from an enlarged surface 532 extending from the periphery of the shoulder 528. The surface 532 extends to an opposed second end 534 of the end form 508. A bore 536 extends axially inward from the second end 534 and is adapted for receiving a separate pin, or the bare ends of a stranded conductor which are fixedly secured in the bore 536 by solder, crimping and/or any other electrical connector joining technique.

The end form 508 is devised for sliding insertion into the bore 540 of the barrel socket 504 through a first end 542 of the barrel socket 504. The length of the first end portion 524 of the end form 508 is selected to provide a suitable insertion distance into the bore 540 in the barrel socket 504. If necessary, this insertion distance may limited by the shoulder 528 contacting the first end 542 of the barrel socket 504 as most closely shown in FIG. 38.

The pull-out force resistance control means 506 according to the present invention includes a stop means 550 which has a central bore 552 having an inner diameter sized to slidably allow insertion of the pin 524 of the end form 508 therethrough. The stop means or member 550 is formed of a flexible material or of a small thinness to permit flexure of an inner edge surrounding the bore 552.

Means 554 are provided for spacing the stop member 550 from the first end 542 of the barrel socket 504 as shown in FIGS. 38–40. The spacer means 554 may be in the form of a generally planar or flat washer having a central bore 556 of an inner diameter larger than the inner diameter of the bore 552 in the stop member 550 and larger than the bore 540 in the barrel socket 504. Means are provided for fixing the stop means 550 and the spacer means 554 in an axial position relative to the first end 542 of the barrel socket 504.

A means for fixing the stop member 550 and the spacer 554 with respect to the barrel socket 504 denoted by reference number 560 is in the form of an end cap having a sidewall 562 and an end wall 564 which define a hollow interior chamber 566. A bore 568 is formed in the end wall 564 and has an inner diameter sized to slidably allow insertion of the pin 524 of the end form 508 therethrough. The inner diameter of the bore 568 may be the same as the inner diameter of the bore 552 in the stop means 550.

The sidewall 562 of the end cap 560 is sized for fixed mounting over the outer sleeve 570 or exposed ends of the grid of the barrel socket 504, depending upon the specific construction or structure of the barrel socket 504 as described above and shown in FIGS. 1–37. In one aspect of the invention, the dimensional relationship between the outer peripheral surface of the barrel socket 504 at the first end 542 and the inner surface 572 of the open ended interior chamber 546 in the end cap 560 is sized for an interference or press-fit. Alternately, the end cap 560 may be fixedly secured to the barrel socket 504 by mechanical fasteners, solder, etc.

As shown in FIG. 40, with a spacer 554, the stop member 550 in the end cap 560 fixedly secured over the first end 542 of the barrel socket 504, either before or after the barrel socket 504 is mounted in the holder 502, the larger interior diameter of the bore 556 in the spacer 554 forms an annular recess 580 between the end 542 of the barrel socket 504 in the adjacent inner diameter edge 582 of the stop member 550.

The recess 580 receives a projection means 584 formed or carried on the pin 524 as shown in FIGS. 38–40. The projection means 584 may comprise a single enlarged projection extending over at least a portion of the circumference of the pin 524, a plurality of coplanar, circumferentially spaced, discrete projections 584, or, in an illustrated aspect of the invention, a single, continuous annular ring extending radially outward from the exterior surface of the end portion 524 of the pin 524 to an outer edge 586 disposed at a given diameter. The diameter of the outer edge 586 of the projection 584 is sized to pass freely through the inner diameter of the bore 568 in the end cap 564 and interfere with the inner edge portion 582 of the stop member 550. However, the insertion force, which may be from ten to twenty pounds, for example, will be sufficient to cause axially inward flexing of the inner edge portion 582 of the stop member 550 in a direction toward the end 542 of the barrel socket 504 to allow the projection 584 to clear the inner diameter of the bore 552 in the stop member 550 and pass into the recess 580 formed internally within the bore 556 of the spacer 554 . After the projection 584 clears the inner edge portion 582, the inner edge portion 582 returns to a planar shape.

Further insertion of the pin 508 into the barrel socket 504 is limited by engagement of the projection 584 with the end 542 of the barrel socket 504 which cannot be radially expanded due to the end cap 560 or the outer sleeve 570. In this manner, the pin 524 is fixedly latched in the barrel socket 504 to complete the electrical connection between the pin 524 and the holder 502.

However, the pin 524 can be forcibly removed from the barrel socket 504 in the holder 502, but at a substantially high pull-out force which acts to forcibly retain the pin 524 in the barrel socket 504 under normal loads. For example, with an electrical connector 500 constructed in accordance with the present invention with the components sized to provide a ten to twenty pound insertion force, the pull-out force may be about fifty pounds. During any pull-out event tending to disengage the pin 524 from the holder 502, which pull-out force may be provided on the holder 502 or the pin 524, or both the projection 584 on the pin 524 will be forced into engagement with the inner edge surface 582 of the stop member 550. However, the inner edge surface 582 is prevented from flexing in an axially outward direction away from the end 542 of the barrel socket 504 by the adjacent inner edge of the end wall 564 of the end cap 560 surrounding the bore 568 in the end cap 560. This adjacency of the two inner edge portions of the end wall 564 of the end cap 560 and the inner edge 582 of the stop member 550 retains the inner edge 582 of the stop member 550 in a planar position resisting passage of the projection 584 there past until a sufficient amount of pull-out force is exerted to deform and bend the inner edge portion 582 of the stop member 550 axially outward at least partially into the bore 568 in the end wall 564 of the end cap 560 until the projection 584 on the pin 524 can pass through the bore 568 in the end cap 560 to provide disengagement of the pin 508 from the holder 502.

The amount of pull-out force resistance provided by the electrical connector 500 can be varied to suit the requirements of a particular application. The pull-out force resistance can be varied by modifying the strength of the material used to form the stop member 550 to thereby provide greater or lesser amounts of flexure capability for the inner edge 582 of the stop member 550. The material forming the projection 584 on the pin 508 can also be varied in strength to provide greater or lesser amounts of force exerted on the stop member 550 before deforming.

In summary, there has been disclosed a unique electrical connector employing a radially resilient electrical barrel socket which has increased pull-out resistance for an electrically conductive end form inserted into the barrel socket over previously devised radially resilient barrel sockets. The increased pull-out force resistance is provided without modification to the structure of the barrel socket and can be easily varied to suit the pull-out force requirements of a particular application.

What is claimed is:

1. An electrical connector comprising:

a radially resilient barrel socket having a bore with a first inner diameter extending from a first end;

a stop member having a bore with a second inner diameter, the second inner diameter being at least as large as the first diameter of the bore in the barrel socket;

means for spacing the stop member from the one end of the barrel socket and defining a recess between the second inner diameter of the bore in the stop member and the one end of the barrel socket, the recess having a third inner diameter greater than the second inner diameter of the bore in the stop member and the first inner diameter of the bore in the barrel socket;

means for fixing the stop member and the spacing means with respect to the one end of the barrel socket;

an electrically conductive member having an end pin insertable through the fixing means, the spacing means, and the stop member into the bore in the barrel socket; and at least one projection carried on the pin, the at least one projection insertable through the inner diameter of a bore formed in the fixing means into the recess defined by the spacing means, an inner edge of the bore in the fixing means and an inner edge of the bore in the spacing means resisting movement of the at least one projection on the pin axially outward from the one end of the barrel socket up to a predetermined pull-out force.

2. The electrical connector of claim 1 wherein the at least one projection comprises:

a plurality of circumferentially spaced, discrete projections carried on the pin.

3. The electrical connector of claim 1 wherein the at least one projection comprises:

a single continuous annular projection carried on the pin.

4. The electrical connector of claim 1 wherein:

the outer diameter of the at least one projection is greater than the second inner diameter of the bore in the spacing means.

5. The electrical connector of claim 1 further comprising:

the spacing means having an inner diameter portion surrounding the bore in the spacing means capable of axial flexure on insertion of the at least one projection on the pin therethrough to allow passage of the at least one projection into the recess; and the fixing means and the spacing means resisting flexure of the inner diameter portion of the spacing means in an axial direction away from the one end of the barrel socket in a direction tending to separate the pin from the barrel socket.

6. The electrical connector of claim 1 wherein the spacing means comprises:

a spacer member having a bore with a third inner diameter, the third inner diameter being larger than the second inner diameter of the stop member and the first inner diameter of the bore in the barrel socket, the recess formed radially inward of the third inner diameter of the spacer member.

7. The electrical connector of claim 6 wherein the spacer member comprises:

a flat washer.

8. The electrical connector of claim 1 wherein the fixing means comprises:

an end cap having a side wall and an end wall, a bore formed in the end wall having an inner diameter sized to allow free passage of the at least one projection therethrough, an inner edge of the end wall surrounding the inner diameter of the bore disposed in substantial engagement with an inner edge of the spacing means surrounding the bore in the spacing means to resist axially outward movement of the inner edge of the spacing means when the pin is moved in an axially outward direction relative to the one end of the barrel socket.

9. The electrical connector of claim 8 wherein the spacing means comprises:

a spacer member having a bore with a third inner diameter, the third inner diameter being larger than the second inner diameter of the stop member and the first inner diameter of the bore in the barrel socket, the recess formed radially inward of the third inner diameter of the spacer member.

10. The electrical connector of claim 8 wherein:

the cap is mounted over the one end of the barrel socket.

11. The electrical connector of claim 10 wherein:

the cap is fixedly mounted on the barrel socket.

12. The electrical connector of claim 11 wherein:

the end cap is press-fit on the barrel socket.

13. An electrical connector comprising:

a radially resilient barrel socket having a bore with a first inner diameter extending from a first end;

a stop member having a bore with a second inner diameter, the second inner diameter being at least as large as the first diameter of the bore in the barrel socket;

means for spacing the stop member from the one end of the barrel socket and defining a recess between the second inner diameter of the bore in the stop member and the one end of the barrel socket, the recess having a third inner diameter greater than the second inner diameter of the bore in the stop member and the first inner diameter of the bore in the barrel socket;

means for fixing the stop member and the spacing means with respect to the one end of the barrel socket;

an electrically conductive member having an end pin insertable through the fixing means, the spacing means, and the stop member into the bore in the barrel socket; and a single annular projection carried on the pin, the projection insertable through the inner diameter of a bore formed in the fixing means into the recess defined by the spacing means, an inner edge of the bore in the fixing means and an inner edge of the bore in the spacing means resisting movement of the projection on the pin axially outward from the one end of the barrel socket up to a predetermined pull-out force.

14. The electrical connector of claim 13 wherein the spacing means comprises:

a spacer member having a bore with a third inner diameter, the third inner diameter being larger than the second inner diameter of the stop member and the first inner diameter of the bore in the barrel socket, the recess formed radially inward of the third inner diameter of the spacer member.

15. The electrical connector of claim 13 wherein the fixing means comprises:

an end cap having a side wall and an end wall, a bore formed in the end wall having an inner diameter sized to allow free passage of the at least one projection therethrough, an inner edge of the end wall surrounding the inner diameter of the bore disposed in substantial engagement with an inner edge of the spacing means surrounding the bore in the spacing means to resist axially outward movement of the inner edge of the spacing means when the pin is moved in an axially outward direction relative to the one end of the barrel socket.

16. The electrical connector of claim 15 wherein:

the end cap is fixedly mounted on the barrel socket.

17. An electrical connector comprising:

a radially resilient barrel socket having a bore with a first inner diameter extending from a first end;

a stop member having a bore with a second inner diameter, the second inner diameter being at least as large as the first diameter of the bore in the barrel socket;

a spacer member spacing the stop member from the one end of the barrel socket and defining a recess between the second inner diameter of the bore in the stop member and the one end of the barrel socket, the recess having a third inner diameter greater than the second inner diameter and the one end of the bore in the barrel socket, the spacer member having a bore with a third inner diameter, the third inner diameter being larger than the second inner diameter of the stop member and the first inner diameter of the bore in the barrel socket, the recess formed radially inward of the third inner diameter of the spacer member;

means for fixing the stop member and the spacer member with respect to the one end of the barrel socket, the fixing means including an end cap having a side wall and an end wall, a bore formed in the end wall having an inner diameter sized to allow free passage of the at least one projection therethrough, an inner edge of the end wall surrounding the inner diameter of the bore disposed in substantial engagement with an inner edge of the spacer member surrounding the bore in the spacing means to resist axially outward movement of the inner edge of the spacing means when the pin is moved in an axially outward direction relative to the one end of the barrel socket;

an electrically conductive member having an end pin insertable through the fixing means, the spacing means, and the stop member into the bore in the barrel socket; and a projection carried on the pin, the projection insertable through the inner diameter of a bore formed in the fixing means into the recess defined by the spacing means, an inner edge of the bore in the fixing means and an inner edge of the bore in the spacing means resisting movement of the projection on the pin axially outward from the one end of the barrel socket up to a predetermined pull-out force.

* * * * *

UNITED STATES PATENT AND TRADEMARK OFFICE

CERTIFICATE OF CORRECTION

PATENT NO. : 6,752,668 B2
DATED : June 22, 2004
INVENTOR(S) : Joseph J. Koch, Jr.

It is certified that error appears in the above-identified patent and that said Letters Patent is hereby corrected as shown below:

Column 2,
Line 53, change "socket; but, also," to -- socket, but also --.

Column 3,
Line 18, change "The at" to -- At --;
Line 23, change "of the at least" to -- of at least --;
Lines 36 and 45, change "the at least" to -- at least --.

Column 4,
Line 57, change "socket," to -- socket; --.

Column 6,
Line 61, change "tabs 26" to -- tabs 26, --.

Column 9,
Line 21, change "With" to -- When --.

Column 13,
Line 21, change "having an" to -- having a --;
Line 47, change "FIGS. 32 and 32" to -- FIGS. 32 and 33 --.

Column 15,
Line 16, change "may limited" to -- may be limited --.

Signed and Sealed this

Twenty-third Day of May, 2006

JON W. DUDAS
*Director of the United States Patent and Trademark Office*